US009562453B2

(12) United States Patent
Bisaiji

(10) Patent No.: US 9,562,453 B2
(45) Date of Patent: Feb. 7, 2017

(54) CONTROL SYSTEM OF INTERNAL COMBUSTION ENGINE

(71) Applicant: Toyota Jidosha Kabushiki Kaisha, Toyota-shi, Aichi-ken (JP)

(72) Inventor: Yuki Bisaiji, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 14/797,624

(22) Filed: Jul. 13, 2015

(65) Prior Publication Data

US 2016/0032800 A1 Feb. 4, 2016

(30) Foreign Application Priority Data

Aug. 4, 2014 (JP) ..... 2014-158838

(51) Int. Cl.

| | |
|---|---|
| ***F01N 3/00*** | (2006.01) |
| ***F01N 3/08*** | (2006.01) |
| *F02D 41/02* | (2006.01) |
| *F01N 3/035* | (2006.01) |
| *F01N 13/00* | (2010.01) |

(52) U.S. Cl.

CPC ..... *F01N 3/0842* (2013.01); *F01N 3/0871* (2013.01); *F01N 3/035* (2013.01); *F01N 13/009* (2014.06); *F01N 2260/04* (2013.01); *F01N 2550/05* (2013.01); *F01N 2610/03* (2013.01); *F01N 2610/144* (2013.01); *F01N 2610/1493* (2013.01); *F01N 2900/04* (2013.01); *F01N 2900/1808* (2013.01); *F01N 2900/1821* (2013.01); *F01N 2900/1822* (2013.01); *F02D 41/0275* (2013.01); *F02M 2200/06* (2013.01)

(58) Field of Classification Search

CPC ..... F01N 3/0842; F01N 3/28; F02D 41/146; F02D 41/0275

USPC ..... 60/286

See application file for complete search history.

(56) References Cited

U.S. PATENT DOCUMENTS

2010/0089366 A1 4/2010 Tanaka
2012/0222411 A1* 9/2012 Yano ..... B01D 53/9418 60/297

FOREIGN PATENT DOCUMENTS

EP 1331373 A2 7/2003
JP 2005307769 A * 11/2005

(Continued)

OTHER PUBLICATIONS

English translation of JP 2005307769A (Nov. 2005).*

*Primary Examiner* — Jason Shanske
(74) *Attorney, Agent, or Firm* — Dinsmore & Shohl LLP

(57) ABSTRACT

An internal combustion engine comprises a hydrocarbon feed valve (15) arranged in an engine exhaust passage and a booster pump (60) for boosting an injection pressure of the hydrocarbon feed valve (15). The hydrocarbon feed valve (15) performs $NO_X$ removal injection and clogging prevention injection. A boosting action of the injection pressure by the booster pump (60) and the $NO_X$ removal injection are controlled so that the boosting action of the injection pressure by the booster pump (60) and the $NO_X$ removal injection are not performed simultaneously, and the boosting action of the injection pressure by the booster pump (60) and said clogging prevention injection are allowed to be performed simultaneously.

9 Claims, 19 Drawing Sheets

(56) References Cited

FOREIGN PATENT DOCUMENTS

| | | | |
|---|---|---|---|
| JP | 2006-266257 | A | 10/2006 |
| JP | 2007-162644 | A | 6/2007 |
| JP | 2008-050988 | A | 3/2008 |
| JP | 2009-270567 | A | 11/2009 |
| JP | 2010-090829 | A | 4/2010 |
| WO | 2009053806 | A2 | 4/2009 |

* cited by examiner

CONTROL SYSTEM OF INTERNAL COMBUSTION ENGINE

TECHNICAL FIELD

The present invention relates to a control system of an internal combustion engine.

BACKGROUND ART

Known in the art is an internal combustion engine which comprises a delivery pipe for distributing fuel to fuel injectors and a high pressure pump for pumping high pressure fuel to the inside of the delivery pipe, wherein the fuel pressure in the delivery pipe is made to become a target fuel pressure by control of a fuel pumping period of the high pressure pump and wherein the fuel injection period is set from the fuel pressure in the delivery pipe before the start of fuel injection and the fuel injection amount determined by the operating state of the engine (see PTL 1). In this internal combustion engine, while fuel is being sent from the high pressure pump to the inside of the delivery pipe, the fuel pressure in the delivery pipe changes, therefore if the fuel pumping time period of the high pressure pump and the fuel injection period overlap, error occurs between the amount of fuel which is actually injected from the fuel injector and the fuel injection amount determined from the operating state of the engine.

Therefore, in this internal combustion engine, when the fuel pumping time period of the high pressure pump and the fuel injection period overlap, the fuel injection period is reset right before or right after the fuel pumping time period so that the overlapping fuel pumping time period of the high pressure pump and the fuel injection period is eliminated or becomes smaller. Further, if resetting the fuel injection period causes error to occur with respect to the fuel injection amount determined from the operating state of the engine, the fuel injection period is adjusted so that error no longer occurs.

On the other hand, known in the art is an internal combustion engine which arranges an $NO_X$ removing catalyst in an exhaust passage, arranges a reducing agent feed valve for feeding a reducing agent upstream of the $NO_X$ removing catalyst in the engine exhaust passage, making the $NO_X$ exhausted from the engine when fuel is being burned under a lean air-fuel ratio be stored in the $NO_X$ removing catalyst, and, when the air-fuel ratio of the exhaust gas flowing into the $NO_X$ removing catalyst should be made rich so as to release the stored $NO_X$ from the $NO_X$ removing catalyst, combustion gas of a rich air-fuel ratio is generated in the combustion chamber or a reducing agent is injected from the reducing agent feed valve in accordance with the operating state of the engine (see PTL 2). In this internal combustion engine, when the air-fuel ratio of the combustion gas in the combustion chamber is switched from lean to rich and the air-fuel ratio of the combustion gas is made rich and the air-fuel ratio of the combustion gas is switched from rich to lean, a large amount of soot is generated. This large amount of generated soot causes the danger of the nozzle holes of the reducing agent feed valve being clogged. Therefore, in this internal combustion engine, in the period from when rich air-fuel ratio fuel is burned to when the next rich air-fuel ratio fuel is burned, the reducing agent feed valve is made to inject a small amount of reducing agent to blow off the soot which is deposited at the nozzle holes and thereby prevent the nozzle holes of the reducing agent feed valve from being clogged.

CITATION LIST

Patent Literature

PTL 1: Japanese Patent Publication No. 2010-90829A
PTL 2: Japanese Patent Publication No. 2009-270567A

SUMMARY OF INVENTION

Technical Problem

In this regard, in the internal combustion engine which is described in the above-mentioned PTL 2, when the stored $NO_X$ should be released from the $NO_X$ removing catalyst, the reducing agent is injected from the reducing agent feed valve, and further, the reducing agent is injected from the reducing agent feed valve to prevent the nozzle holes of the reducing agent feed valve from clogging. However, even if the reducing agent is injected into the engine exhaust passage from the reducing agent feed valve, if the boosting action of the reducing agent injected from the reducing agent feed valve and the injection timing of the reducing agent from the reducing agent feed valve overlap, deviation should occur between the injection amount of the reducing agent actually injected from the reducing agent feed valve and the optimal target injection amount. Therefore, in the internal combustion engine which is described in this PTL 2 as well, in the same way as the internal combustion engine which is described in PTL 1, if the boosting action of the reducing agent and the injection timing of the reducing agent overlap, it may be considered to make the injection timing of the reducing agent change so that the boosting action of the reducing agent and injection timing of the reducing agent do not overlap.

However, unlike the case of injecting fuel from the fuel injector into the combustion chamber like in the internal combustion engine which is described in PTL 1, the injection of the reducing agent from the reducing agent feed valve is performed for various different purposes. In this case, when the boosting action of the reducing agent and the injection timing of the reducing agent overlap, it differs depending on the purpose of injecting the reducing agent as to whether it is better to make the boosting action of the reducing agent and the injection timing of the reducing agent not overlap or whether it is better to leave the boosting action of the reducing agent and the injection timing of the reducing agent overlapping. However, in neither of the patent literature is this considered at all.

Solution to Problem

Therefore, in the present invention, there is provided a control system of an internal combustion engine comprising a reducing agent feed valve arranged in an engine exhaust passage, an $NO_X$ purification device which removes $NO_X$ by a reducing agent injected from the reducing agent feed valve, and a booster device for boosting an injection pressure of a reducing agent injected from the reducing agent feed valve, wherein an $NO_X$ removal injection of injection of a reducing agent from the reducing agent feed valve which is repeatedly performed within a predetermined range of period so as to remove $NO_X$ and a clogging prevention injection of injection of the reducing agent from the reducing agent feed valve which is made smaller in amount of injection compared with the $NO_X$ removal injection for preventing clogging of nozzle holes of the reducing agent feed valve are performed, a boosting action of the injection pressure by the booster device and the $NO_X$ removal injection are controlled so that the boosting action of the injection pressure by the booster device and the $NO_X$ removal injection are not simultaneously performed, and the boosting action of the injection pressure by the booster device and the clogging prevention injection are allowed to be performed simultaneously.

Advantageous Effects of Invention

If the boosting action of the injection pressure by the booster device and the $NO_X$ removal injection are performed simultaneously, the removal performance of $NO_X$ will be greatly affected. Therefore, the boosting action of the injection pressure by the booster device and the $NO_X$ removal injection are made not to be performed simultaneously and thereby a good $NO_X$ removal action is secured. On the other hand, even if the boosting action of the injection pressure by the booster device and the clogging prevention injection overlap, there is no adverse effect at all. Therefore, in this case, the boosting action of the injection pressure by the booster device and the clogging prevention injection are allowed to be performed simultaneously. Due to this, complicated control no longer has to be performed for preventing the boosting action of the injection pressure by the booster device and the clogging prevention injection from being performed simultaneously.

DESCRIPTION OF EMBODIMENTS

Figure 1:
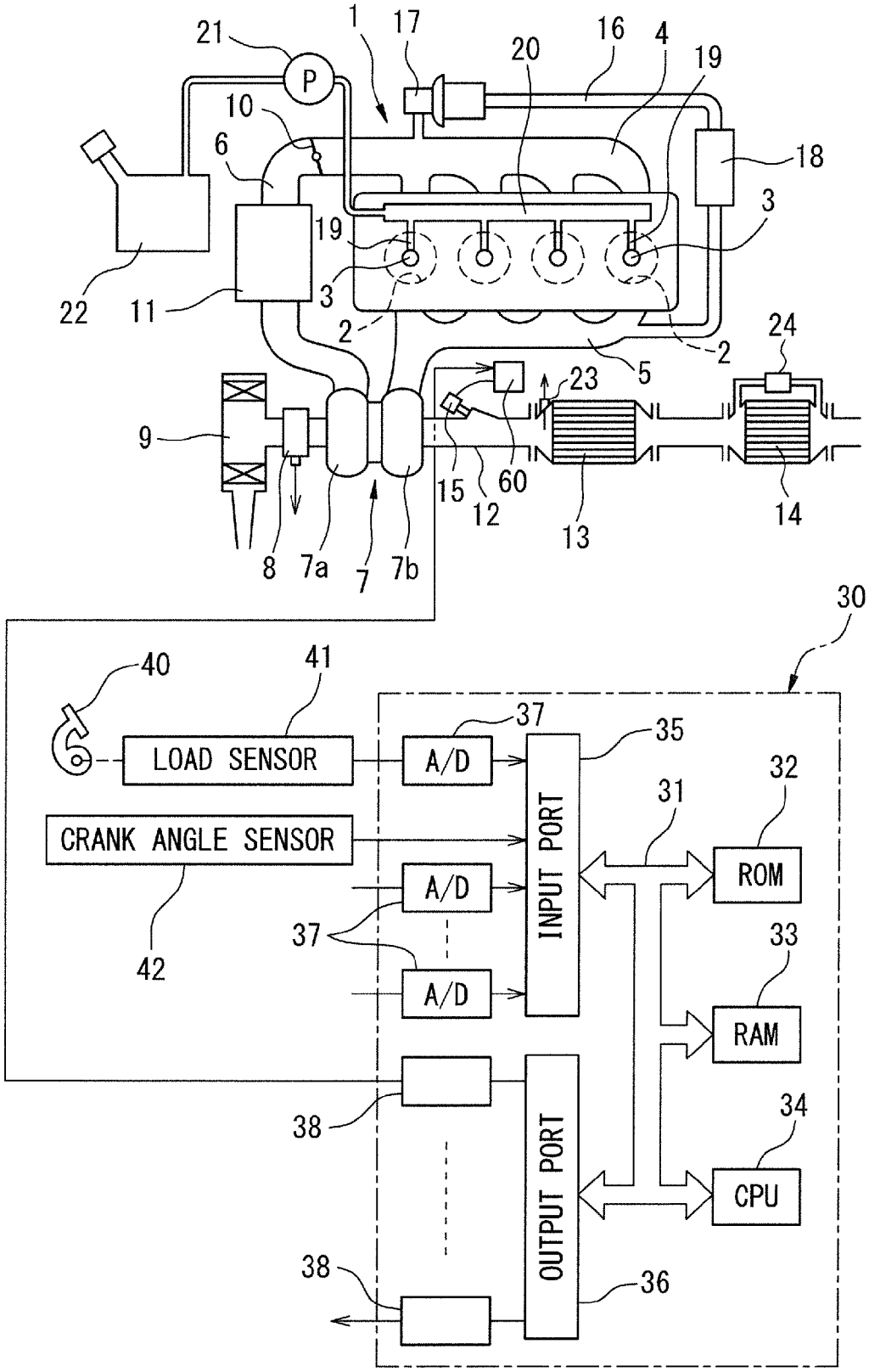
FIG. 1 is an overview of a compression ignition type internal combustion engine.

FIG. 1 is an overall view of a compression ignition type internal combustion engine.

Referring to FIG. 1, 1 indicates an engine body, 2 a combustion chamber of each cylinder, 3 an electronically controlled fuel injector for injecting fuel into each combustion chamber 2, 4 an intake manifold, and 5 an exhaust manifold. The intake manifold 4 is connected through an intake duct 6 to an outlet of a compressor 7*a* of an exhaust turbocharger 7, while an inlet of the compressor 7*a* is connected through an intake air amount detector 8 to an air cleaner 9. Inside the intake duct 6, a throttle valve 10 which is driven by an actuator is arranged. Around the intake duct 6, a cooling device 11 is arranged for cooling the intake air which flows through the inside of the intake duct 6. In the embodiment which is shown in FIG. 1, the engine cooling water is guided to the inside of the cooling device 11 where the engine cooling water is used to cool the intake air.

On the other hand, the exhaust manifold 5 is connected to an inlet of an exhaust turbine 7*b* of the exhaust turbocharger 7, and an outlet of the exhaust turbine 7*b* is connected through an exhaust pipe 12 to an inlet of an exhaust purification device 13. In an embodiment of the present invention, this exhaust purification device 13 is comprised of an exhaust purification catalyst and, in an embodiment of the present invention, this exhaust purification catalyst 13 is comprised of an $NO_X$ storage catalyst. An outlet of the exhaust purification catalyst 13 is connected to a particulate filter 14 and, upstream of the exhaust purification catalyst 13 inside the exhaust pipe 12, a hydrocarbon feed valve 15 is arranged for feeding hydrocarbons comprised of diesel oil or other fuel used as fuel for a compression ignition type internal combustion engine. In the embodiment shown in FIG. 1, diesel oil is used as the hydrocarbons which are fed from the hydrocarbon feed valve 15. Note that, the present invention can also be applied to a spark ignition type internal combustion engine in which fuel is burned under a lean air-fuel ratio. In this case, from the hydrocarbon feed valve 15, hydrocarbons comprised of gasoline or other fuel used as fuel of a spark ignition type internal combustion engine are fed.

On the other hand, the exhaust manifold 5 and the intake manifold 4 are connected with each other through an exhaust gas recirculation (hereinafter referred to as an "EGR") passage 16. Inside the EGR passage 16, an electronically controlled EGR control valve 17 is arranged. Further, around the EGR passage 16, a cooling device 18 is arranged for cooling the EGR gas which flows through the inside of the EGR passage 16. In the embodiment which is shown in FIG. 1, the engine cooling water is guided to the inside of the cooling device 18 where the engine cooling water is used to cool the EGR gas. On the other hand, each fuel injector 3 is connected through a fuel feed tube 19 to a common rail 20. This common rail 20 is connected through an electronically controlled variable discharge fuel pump 21 to a fuel tank 22. The fuel which is stored inside of the fuel tank 22 is fed by the fuel pump 21 to the inside of the common rail 20. The fuel which is fed to the inside of the common rail 20 is fed through each fuel feed tube 19 to the fuel injector 3.

An electronic control unit 30 is comprised of a digital computer provided with a ROM (read only memory) 32, a RAM (random access memory) 33, a CPU (microprocessor) 34, an input port 35, and an output port 36, which are connected with each other by a bidirectional bus 31. Downstream of the exhaust purification catalyst 13, a temperature sensor 23 is arranged for detecting the temperature of the exhaust gas flowing out from the exhaust purification catalyst 13, and a pressure difference sensor 24 for detecting a pressure difference before and after the particulate filter 14 is attached to the particulate filter 14. The output signals of these temperature sensor 23, pressure difference sensor 24 and intake air amount detector 8 are input through respectively corresponding AD converters 37 to the input port 35. Further, an accelerator pedal 40 has a load sensor 41 connected to it which generates an output voltage proportional to the amount of depression L of the accelerator pedal 40. The output voltage of the load sensor 41 is input through a corresponding AD converter 37 to the input port 35. Furthermore, at the input port 35, a crank angle sensor 42 is connected which generates an output pulse every time a crankshaft rotates by, for example, 15°. On the other hand, the output port 36 is connected through corresponding drive circuits 38 to each fuel injector 3, the actuator for driving the throttle valve 10, hydrocarbon feed valve 15, EGR control valve 17, and fuel pump 21.

Figure 2:
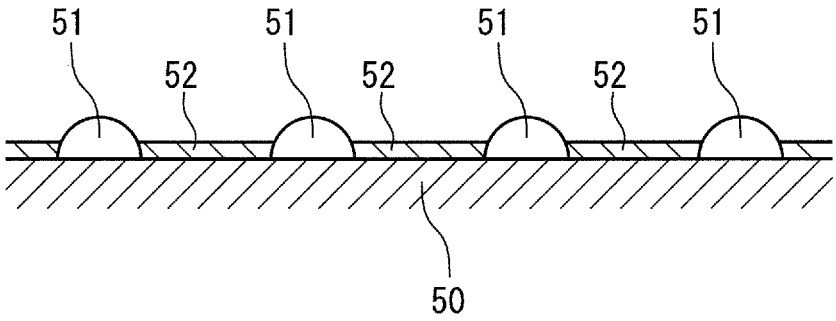
FIG. 2 is a view which schematically shows a surface part of a catalyst carrier.

FIG. 2 schematically shows a surface part of a catalyst carrier which is carried on a substrate of the exhaust purification catalyst 13 shown in FIG. 1. At this exhaust purification catalyst 13, as shown in FIG. 2, for example, there is provided a catalyst carrier 50 made of alumina on which precious metal catalysts 51 comprised of platinum Pt are carried. Furthermore, on this catalyst carrier 50, a basic layer 52 is formed which includes at least one element selected from potassium K, sodium Na, cesium Cs, or another such alkali metal, barium Ba, calcium Ca, or another such alkali earth metal, a lanthanide or another such rare earth and silver Ag, copper Cu, iron Fe, iridium Ir, or another metal able to donate electrons to $NO_X$. In this case, on the catalyst carrier 50 of the exhaust purification catalyst 13, in addition to platinum Pt, rhodium Rh or palladium Pd may be further carried.

Figure 3:
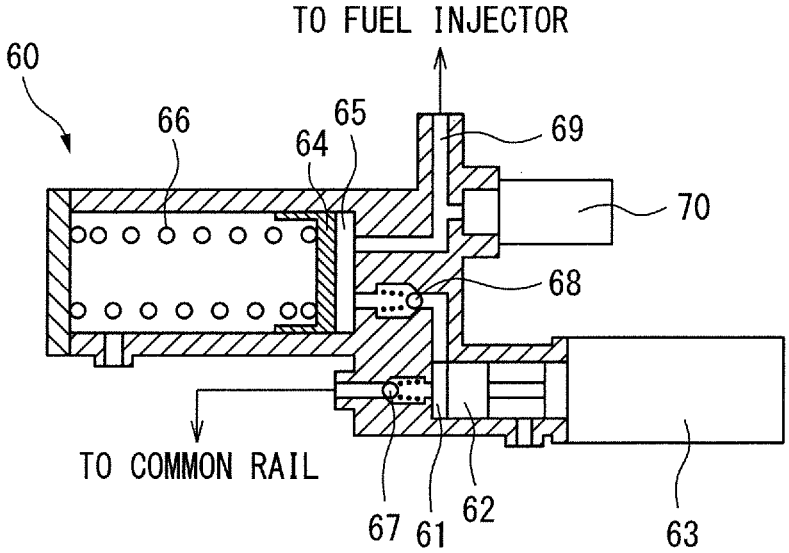
FIG. 3 is a cross-sectional view of a booster pump.

As shown in FIG. 1, the hydrocarbon feed valve 15 is provided with a booster device 60 for boosting the injection pressure of hydrocarbons which are injected from the hydrocarbon feed valve 15. In this embodiment according to the present invention, this booster device 60 is comprised of a booster pump. FIG. 3 is a cross-sectional view of this booster pump 60. As shown in FIG. 3, the booster pump 60 comprises a pump chamber 61 which is filled with pressurized fuel, a pressurizing piston 62 for pressurizing the fuel in the pump chamber 61, an actuator 63 for driving the pressurizing piston 62, an accumulator chamber 65 which is defined by an accumulator piston 64 and is filled with pressurized fuel, and a spring member 66 which biases the accumulator piston 64 toward the accumulator chamber 65. The pump chamber 61, on the other hand, is connected to the inside of the common rail 20 through a check valve 67 which allows flow only from the inside of the common rail 20 toward the pump chamber 61 and on the other hand is connected with an accumulator chamber 65 through a check valve 68 which allows flow only from the pump chamber 61 to the accumulator chamber 65. Further, the accumulator chamber 65 is connected with the hydrocarbon feed valve 15 through a pressurized fuel outflow passage 69. Fuel pressure inside of the pressurized fuel outflow passage 69 is detected by a pressure sensor 70.

If the actuator 63 causes the pressurizing piston 62 to be moved rightward in FIG. 3, the fuel inside of the common rail 20 is sent through the check valve 67 to the inside of the pump chamber 61. If the actuator 63 causes the pressurizing piston 62 to be moved leftward in FIG. 3, the fuel inside of the pump chamber 61 is pressurized and sent through the check valve 68 to the inside of the accumulator chamber 65, then is fed through the pressurized fuel outflow passage 69 to the hydrocarbon feed valve 15. The fuel, that is, hydrocarbons, which is fed to the hydrocarbon feed valve 15 is injected from the nozzle openings of the hydrocarbon feed valve 15 into the exhaust gas.

Figure 4:
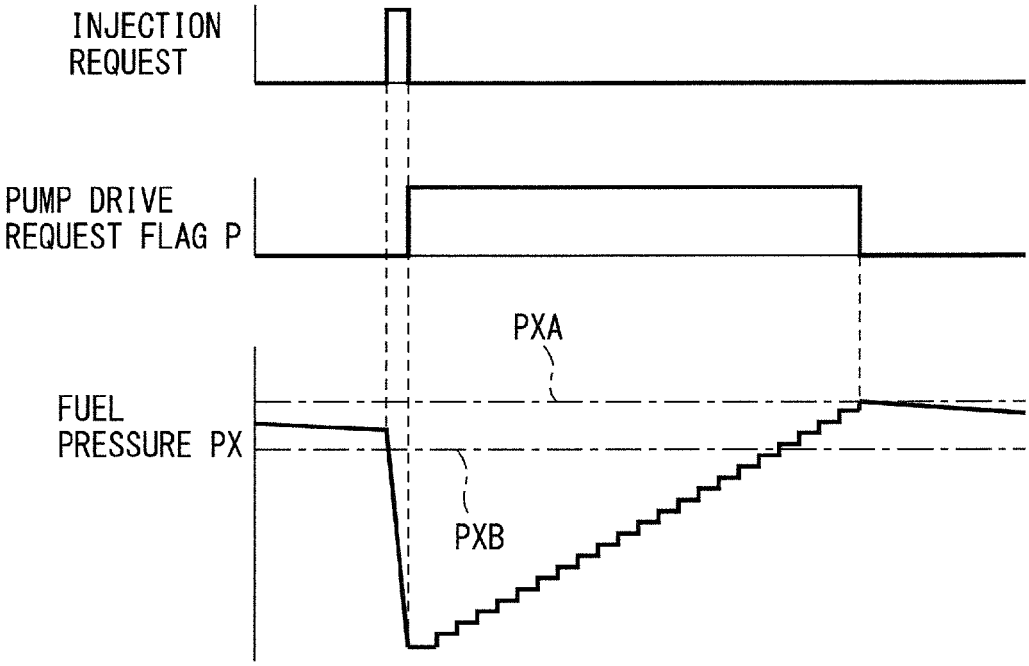
FIG. 4 is a view which shows changes in a fuel pressure PX etc. of fuel which is fed to a hydrocarbon feed valve.

FIG. 4 shows changes in a request for injection of hydrocarbons from the hydrocarbon feed valve 15, a pump drive request flag P for requesting drive of the pressurizing piston 62 by the actuator 63, and a fuel pressure PX of fuel which is fed to the hydrocarbon feed valve 15. Note that, the fuel pressure PX of the fuel which is fed to the hydrocarbon feed valve 15 is equal to the fuel pressure inside of the pressurized fuel outflow passage 69, therefore the fuel pressure which is detected by the pressure sensor 70 is shown as the fuel pressure PX. As shown in FIG. 4, the target fuel pressure PXA for the fuel pressure PX and the allowable lower limit fuel pressure PXB which is somewhat lower in pressure than this target fuel pressure PXA are set in advance. The fuel pressure PX of the fuel which is fed to the hydrocarbon feed valve 15 is usually maintained between the target fuel pressure PXA and the allowable lower limit fuel pressure PXB.

If a request for injection of hydrocarbons is made, the hydrocarbon feed valve 15 is made to open, whereby fuel, that is, hydrocarbons, is injected from the hydrocarbon feed valve 15. If hydrocarbons are injected from the hydrocarbon feed valve 15, as shown in FIG. 4 by the solid line, the fuel pressure PX of the fuel which is fed to the hydrocarbon feed valve 15 rapidly falls. Next, if injection is completed, a pump drive request flag P is set. If the pump drive request flag P is set, the booster pump 60 starts to be driven and the actuator 63 is repeatedly driven. As a result, the pressurizing piston 62 repeatedly pressurizes the fuel inside of the pump chamber 61. Each time the fuel inside of the pump chamber 61 is pressurized, the fuel pressure inside of the accumulator chamber 65 rises, so the fuel pressure PX gradually rises.

Next, if the fuel pressure PX reaches the target fuel pressure PXA, as shown in FIG. 4, the pump drive request flag P is reset and the booster pump 60 stops being driven.

On the other hand, the fuel inside of the accumulator chamber 65 leaks through the surroundings of the accumulator piston 64. Therefore, if the booster pump 60 stops being driven, as shown in FIG. 4 by the solid line, the fuel pressure PX falls a little at a time. Next, if the fuel pressure PX falls to the allowable lower limit fuel pressure PXB, the pump drive request flag P is set and the booster pump 60 is driven until the fuel pressure PX reaches the target fuel pressure PXA.

Now, as mentioned above, the exhaust purification catalyst 13 is comprised of an $NO_X$ storage catalyst, and if the ratio of the air and fuel (hydrocarbons) which are supplied into the engine intake passage, combustion chambers 2, and upstream of the exhaust purification catalyst 13 in the exhaust passage is referred to as "the air-fuel ratio of the exhaust gas", the exhaust purification catalyst 13 has a function of storing $NO_X$ when the air-fuel ratio of the exhaust gas is lean and releasing the stored $NO_X$ when the air-fuel ratio of the exhaust gas is made rich. Namely, when the air-fuel ratio of the exhaust gas is lean, $NO_X$ contained in the exhaust gas is oxidized on the platinum Pt 51. Then, this $NO_X$ diffuses in the basic layer 52 in the form of nitrate ions $NO_3^-$ and becomes nitrates. Namely, at this time, $NO_X$ contained in the exhaust gas is absorbed in the form of nitrates inside of the basic layer 52. On the other hand, when the air-fuel ratio of the exhaust gas is made rich, the oxygen concentration in the exhaust gas falls. As a result, the reaction proceeds in the opposite direction ($NO_3^- \rightarrow NO_2$), and consequently the nitrates absorbed in the basic layer 52 successively become nitrate ions $NO_3^-$ and are released from the basic layer 52 in the form of $NO_2$. Next, the released $NO_2$ is reduced by the hydrocarbons HC and CO contained in the exhaust gas.

Figure 5:
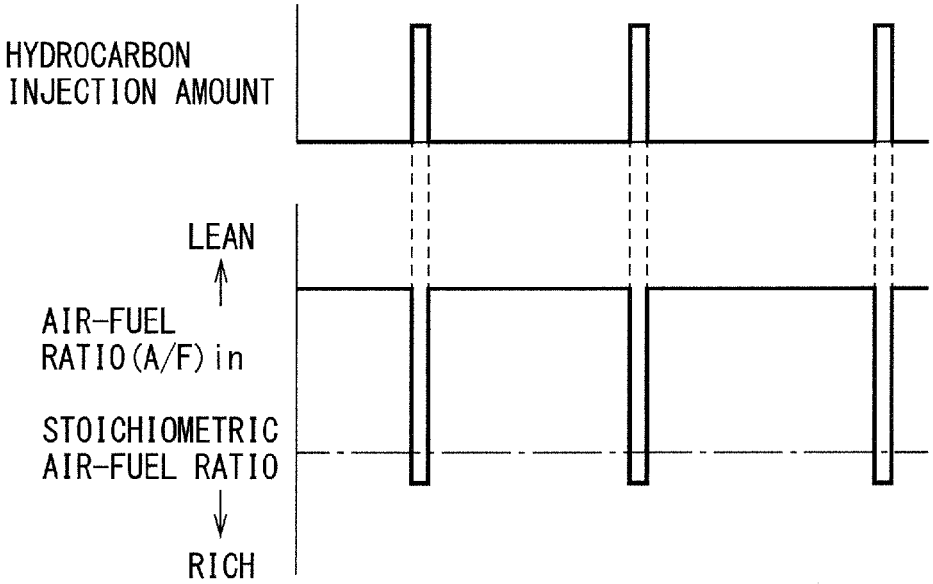
FIG. 5 is a view which shows changes in a hydrogen injection amount and the air-fuel ratio of exhaust gas which flows into the exhaust purification catalyst.

FIG. 5 shows the case of making the air-fuel ratio (A/F) in of the exhaust gas flowing into the exhaust purification catalyst 13 temporarily rich by making the air-fuel ratio of the combustion gas in the combustion chamber 2 slightly before the $NO_X$ absorption ability of the basic layer 52 becomes saturated. In this case, the air-fuel ratio (A/F) in of the exhaust gas flowing into the exhaust purification catalyst 13 is made temporarily rich by injecting hydrocarbons from the hydrocarbon feed valve 15 only in a particular operating state where the air-fuel ratio of the combustion gas in the combustion chamber 2 cannot be made rich. Note that, in the example shown in FIG. 5, the time interval of this rich control is 1 minute or more. In this case, the $NO_X$ which was absorbed in the basic layer 52 when the air-fuel ratio (A/F) in of the exhaust gas was lean is released all at once from the basic layer 52 and reduced when the air-fuel ratio (A/F) in of the exhaust gas is made temporarily rich. In case where $NO_X$ is removed by using the storage and release action of $NO_X$ in this way, when the catalyst temperature TC is 250° C. to 300° C., an extremely high $NO_X$ purification rate is obtained. However, when the catalyst temperature TC becomes a 350° C. or higher high temperature, the $NO_X$ purification rate falls.

Figure 6A:
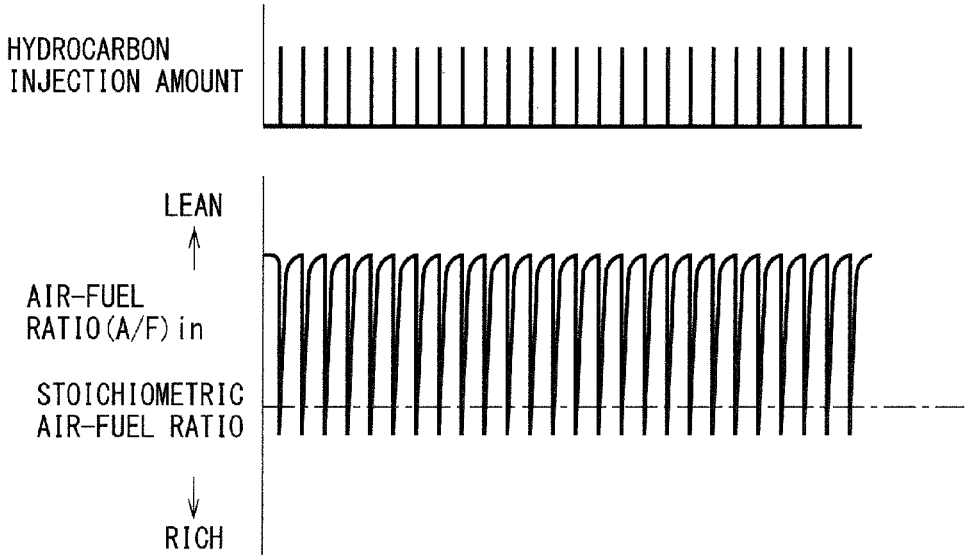
FIG. 6A is a view which shows changes in the hydrocarbon injection amount and the air-fuel ratio of exhaust gas which flows into the exhaust purification catalyst in a case where hydrocarbons are injected to remove NOR.

On the other hand, if injecting hydrocarbons from the hydrocarbon feed valve 15 with a short injection period to make the air-fuel ratio of the exhaust gas rich before $NO_X$ is absorbed in the basic layer 52, reducing intermediates comprised of the isocyanate compound R—NCO and amine compound R—$NH_2$ etc. are produced from hydrocarbons injected from the hydrocarbon feed valve 15 and $NO_X$ contained in the exhaust gas, and these reducing intermediates are held on the basic layer 52 without being absorbed in the basic layer 52. Then, $NO_X$ contained in the exhaust gas is reduced by these reducing intermediates. FIG. 6A shows changes in the amount of hydrocarbons injected from the hydrocarbon feed valve 15 and the air-fuel ratio (A/F) in of the exhaust gas flowing into the exhaust purification catalyst 13 in case where $NO_X$ is removed by producing these reducing intermediates. In this case, a period in which the air-fuel ratio (A/F) in of the exhaust gas flowing into the exhaust purification catalyst 13 is made rich is shorter as compared with the case shown in FIG. 5, and in the example shown in FIG. 6A, the period in which the air-fuel ratio (A/F) in of the exhaust gas flowing into the exhaust purification catalyst 13 is made rich, that is, the injection interval of hydrocarbons from the hydrocarbon feed valve 15 is made 3 seconds.

On the other hand, in case where $NO_X$ is removed by using the storage and release action of $NO_X$, as mentioned above, when the catalyst temperature TC becomes 350° C. or more, the $NO_X$ purification rate falls. This is because if the catalyst temperature TC becomes 350° C. or more, $NO_X$ is less easily stored and the nitrates break down by heat and are released in the form of $NO_2$ from the exhaust purification catalyst 13. That is, so long as storing $NO_X$ in the form of nitrates, when the catalyst temperature TC is high, it is difficult to obtain a high $NO_X$ purification rate. However, in the $NO_X$ purification method shown in FIG. 6A, the amount of $NO_X$ stored in the form of nitrates is small, and consequently, even when the catalyst temperature TC is high of 400° C. or more, a high $NO_X$ purification rate can be obtained. This $NO_X$ purification method shown in FIG. 6A will be referred to below as the "first $NO_X$ purification method", and the $NO_X$ purification method by using the storage and release action of $NO_X$ as shown in FIG. 5 will be referred to below as the "second $NO_X$ purification method"

Note that, as mentioned above, when the catalyst temperature TC is relatively low, the $NO_X$ purification rate by the second $NO_X$ purification method becomes higher, while when the catalyst temperature TC becomes higher, the $NO_X$ purification rate by the first $NO_X$ purification method becomes higher. Accordingly, in the embodiment of the present invention, roughly speaking, when the catalyst temperature TC is low, the second $NO_X$ purification method is used, and when the catalyst temperature TC is high, the first $NO_X$ purification method is used.

Figure 6B:
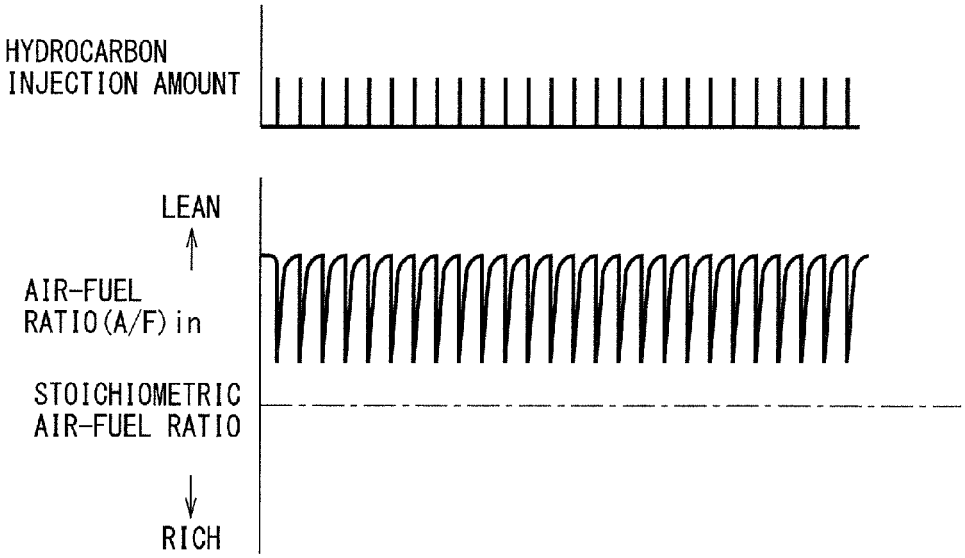
FIG. 6B is a view which shows changes in the hydrocarbon injection amount and the air-fuel ratio of exhaust gas which flows into the exhaust purification catalyst in a case where hydrocarbons are injected to raise the temperature of the particulate filter or the exhaust purification catalyst.

On the other hand, when regenerating the particulate filter 14, hydrocarbons are injected from the hydrocarbon feed valve 15, and the temperature elevation action of the particulate filter 14 is performed due to the heat of oxidation reaction of the injected hydrocarbons. In addition, also when releasing $SO_X$ stored in the exhaust purification catalyst 13 from the exhaust purification catalyst 13, hydrocarbons are injected from the hydrocarbon feed valve 15, and the temperature elevation action of the exhaust purification catalyst 13 is performed due to the heat of oxidation reaction of the injected hydrocarbons. FIG. 6B shows changes in the amount of hydrocarbons injected from the hydrocarbon feed valve 15 and the air-fuel ratio (A/F) in of the exhaust gas flowing into the exhaust purification catalyst 13 in case where hydrocarbons are injected from the hydrocarbon feed valve 15 to raise the temperature of the particulate filter 14 or the exhaust purification catalyst 13 in this way. At this time, as can be seen from FIG. 6B, hydrocarbons are injected from the hydrocarbon feed valve 15 with a short injection period which is similar to that in the case shown in FIG. 6A while maintaining the air-fuel ratio (A/F) in of the exhaust gas flowing into the exhaust purification catalyst 13 lean.

Figure 7A:
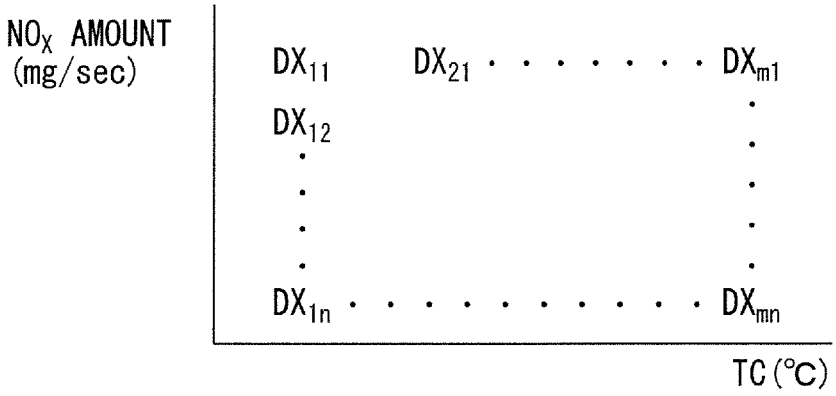
FIG. 7A is a view which shows a map of an injection density DX of hydrocarbons.

Next, the method of calculation of the amount of injection of hydrocarbons from the hydrocarbon feed valve 15 when the first $NO_X$ removal method is being used and the method of calculation of the amount of injection of hydrocarbons from the hydrocarbon feed valve 15 when making the particulate filter 14 or the exhaust purification catalyst 13 rise in temperature will be simply explained. First, if explaining the method of calculation of the amount of injection of hydrocarbons from the hydrocarbon feed valve 15 when the first $NO_X$ removal method is being used, to make the $NO_X$ which flows into the exhaust purification catalyst 13 be reduced, an amount of hydrocarbons which is proportional to the amount of $NO_X$ (mg/s) which flows into the exhaust purification catalyst 13 per unit time is necessary. On the other hand, the efficiency of reduction of $NO_X$ is a function of the temperature TC of the exhaust purification catalyst 13. Therefore, the amount of injection of hydrocarbons per unit time, that is, the injection density (mg/s), which is necessary for reducing the $NO_X$ which flows into the exhaust purification catalyst 13, becomes a function of the amount of $NO_X$ (mg/s) which flows into the exhaust purification catalyst 13 per unit time and the temperature TC of the exhaust purification catalyst 13. In this embodiment according to the present invention, this injection density DX (mg/s) of hydrocarbons is stored as a function of the amount of $NO_X$ (mg/s) which flows into the exhaust purification catalyst 13 per unit time and the temperature TC of the exhaust purification catalyst 13 in the form of a map such as shown in FIG. 7A in advance in the ROM 32.

On the other hand, if the amount of injection of hydrocarbons per injection from the hydrocarbon feed valve 15 becomes greater, the hydrocarbons will end up slipping through the exhaust purification catalyst 13. In this case, the upper limit of the amount of injection (mg) of hydrocarbons per injection is determined by the operating state of the engine. Therefore, in this embodiment according to the present invention, the amount of injection (mg) of hydrocarbons per injection is stored as a function of the fuel injection amount Q (mg) to the inside of the combustion chamber 2 and the engine speed N in the form of a map such as shown in FIG. 7C in advance in the ROM 32. In this embodiment according to the present invention, the injection interval (s) of hydrocarbons is calculated by dividing the amount of injection W (mg) of hydrocarbons per injection which is shown in FIG. 7C by the injection density DX (mg/s) of hydrocarbons which is shown in FIG. 7A. That is, the next injection timing of hydrocarbons is found.

Next, the method of calculation of the amount of injection of hydrocarbons from the hydrocarbon feed valve 15 when making the particulate filter 14 rise in temperature will be simply explained. The injection density DY (mg/s) of hydrocarbons per unit time when making the temperature of the particulate filter 14 rise is made higher the larger the temperature difference (TG-TC) between the current temperature TC of the exhaust purification catalyst 13 and the target temperature TG. On the other hand, the injection density DY (mg/s) of hydrocarbons per unit time is made higher the greater the amount of exhaust gas (g/s). Therefore, the injection density DY (mg/s) of hydrocarbons per unit time when making the temperature of the particulate filter 14 rise becomes a function of the temperature difference (TG-TC) of the current temperature TC of the exhaust purification catalyst 13 and the target temperature TG and the amount of exhaust gas (g/s). Therefore, in this embodiment according to the present invention, the injection density DY (mg/s) of hydrocarbons per unit time when making the temperature of the particulate filter 14 rise is stored as a function of the temperature difference (TG-TC) and amount of exhaust gas (g/s) in the form of a map such as shown in FIG. 7B in advance in the ROM 32.

Figure 7B:
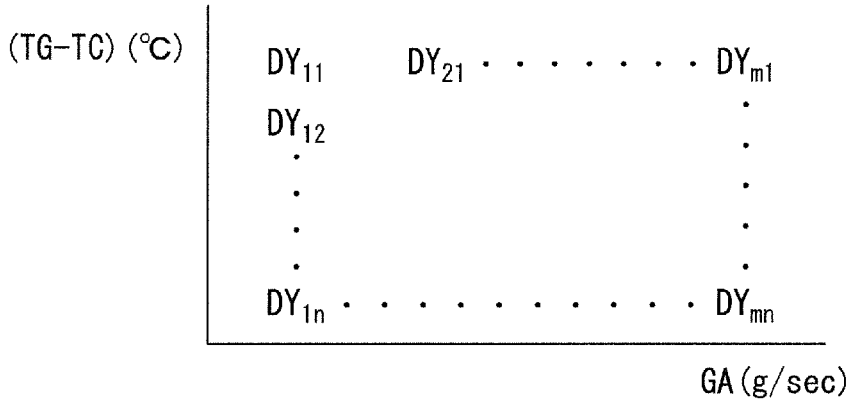
FIG. 7B is a view which shows a map of an injection density DY of hydrocarbons.
Figure 7C:
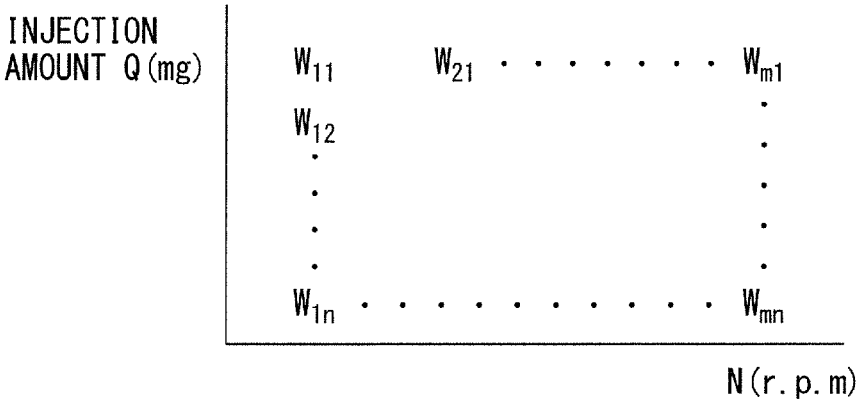
FIG. 7C is a view which shows a map of an injection amount W of hydrocarbons per injection.

In this embodiment according to the present invention, the injection interval (s) of hydrocarbons is calculated by dividing the amount of injection W (mg) of hydrocarbons per injection which is shown in FIG. 7C by the injection density DY (mg/s) of hydrocarbons which is shown in FIG. 7B. That is, the next injection timing of hydrocarbons is found. Note that, the injection density (mg/s) of hydrocarbons per unit time when making the temperature of the exhaust purification catalyst 13 rise so as to make the $SO_X$ which is stored in the exhaust purification catalyst 13 be released from the exhaust purification catalyst 13 is stored in the form of a map such as shown in FIG. 7B in advance in the ROM 32. In this case as well, the injection interval (s) of hydrocarbons is calculated by dividing the amount of injection W (mg) of hydrocarbons per injection which is shown in FIG. 7C by the injection density (mg/s) of hydrocarbons which is stored in the ROM 32 in advance. That is, the next injection timing of hydrocarbons is found.

Figure 8A:
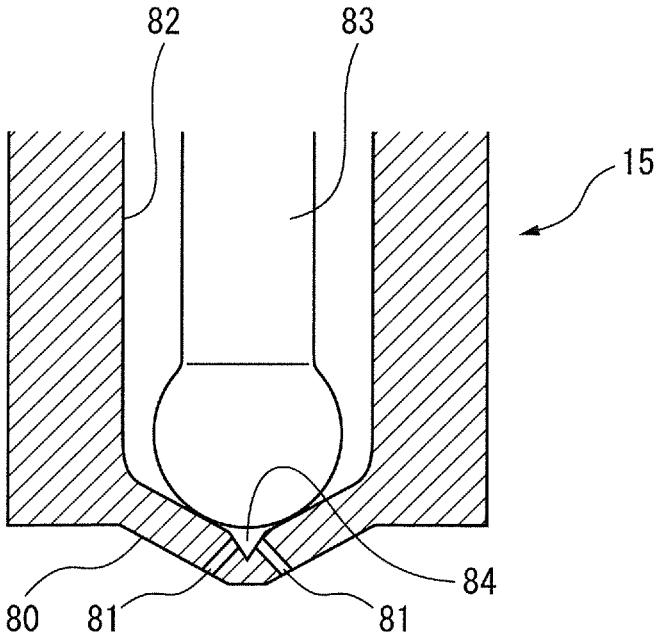
FIG. 8A is a view for explaining deposition of soot to the inner circumferential surfaces of nozzle holes.

Next, referring to FIG. 8A and FIG. 8B, the mechanism of clogging of nozzle holes of the hydrocarbon feed valve 15 which was discovered by the present inventors will be explained. FIG. 8A shows the front end part of the hydrocarbon feed valve 15. The front end face 80 of the front end part of the hydrocarbon feed valve 15 is exposed inside of the exhaust pipe 12. In this front end face 80, a plurality of nozzle holes 81 are formed. At the inside of the front end part of the hydrocarbon feed valve 15, a hydrocarbon chamber 82 which is filled with a liquid hydrocarbon is formed. In this hydrocarbon chamber 82, a needle valve 83 which is driven by a solenoid is arranged. FIG. 8A shows when the needle valve 83 sits on the bottom surface of the hydrocarbon chamber 82. At this time, the injection of hydrocarbons from the nozzle holes 81 is made to stop. Note that, at this time, between the front end face of the needle valve 83 and the bottom surface of the hydrocarbon chamber 82, a suck chamber 84 is formed. The inside end portions of the nozzle holes 81 open to the inside of this suck chamber 84.

If the needle valve 83 is made to rise and separates from the bottom surface of the hydrocarbon chamber 82, the hydrocarbons in the hydrocarbon chamber 82 will be injected through the suck chamber 84 from the nozzle holes 81 into the exhaust pipe 12. Therefore, this hydrocarbon feed valve 15 is comprised of a hydrocarbon feed valve of a type which is provided with nozzle holes 81 which open inside of the engine exhaust passage and is controlled to open and close at the inside end side of the nozzle holes 81. In such a type of hydrocarbon feed valve 15, in the past, it was thought that if the engine discharged soot, the soot would invade the inside of the nozzle holes 81 of the hydrocarbon feed valve 15 and would deposit and build up on the inner circumferential walls of the nozzle holes 81 whereby the nozzle holes 81 would clog. However, the inventors engaged in repeated research on the clogging of nozzle holes 81 and as a result learned that when the hydrocarbon feed valve 15 is not injecting hydrocarbons, even if the engine discharges a large amount of soot, the soot will not invade the nozzle holes 81 and therefore the discharge of a large amount of soot from an engine is not the cause of clogging of nozzle holes 81 but that clogging is caused by soot being sucked into the nozzle holes 81 at the time of end of injection of hydrocarbons from the hydrocarbon feed valve 15.

That is, in a hydrocarbon feed valve 15 of the type such as shown in FIG. 8A, when stopping injection of hydrocarbons from the hydrocarbon feed valve 15 at the time of end of injection by making the needle valve 83 close, the hydrocarbons which are present in the suck chamber 84 and nozzle holes 81 flow out from the nozzle holes 81 by inertia. As a result, at this time, the inside of the suck chamber 84 and the insides of the nozzle holes 81 temporarily become negative pressures. Therefore, at this time, if the exhaust gas around the openings of the nozzle holes 81 which open to the inside of the exhaust passage contains soot, the soot will be sucked into the nozzle holes 81 and suck chamber 84 and the soot will deposit on the inner circumferential surfaces at the insides of the nozzle holes 81 and suck chamber 84. However, even if soot deposits on the inner circumferential surfaces of the nozzle holes 81 and inner circumferential surfaces of the suck chamber 84 in this way, if next injecting fuel from the hydrocarbon feed valve 15 in a short time period, the soot which has deposited on the inner circumferential surfaces of the nozzle holes 81 and inner circumferential surfaces of the suck chamber 84 will be blown off. Therefore, in this case, the nozzle holes 81 will never clog. In this regard, if time elapses from when soot deposited on the inner circumferential surfaces of the nozzle holes 81 and inner circumferential surfaces of the suck chamber 84, the soot will adhere to the inner circumferential surfaces of the nozzle holes 81 and inner circumferential surfaces of the suck chamber 84. If the soot adheres to the inner circumferential surfaces of the nozzle holes 81 and inner circumferential surfaces of the suck chamber 84 in this way, even if hydrocarbons are injected, the soot will no longer be blown off. As a result, the nozzle holes 81 will clog. Next, this action of adherence of the soot will be explained with reference to FIG. 8B.

Figure 8B:
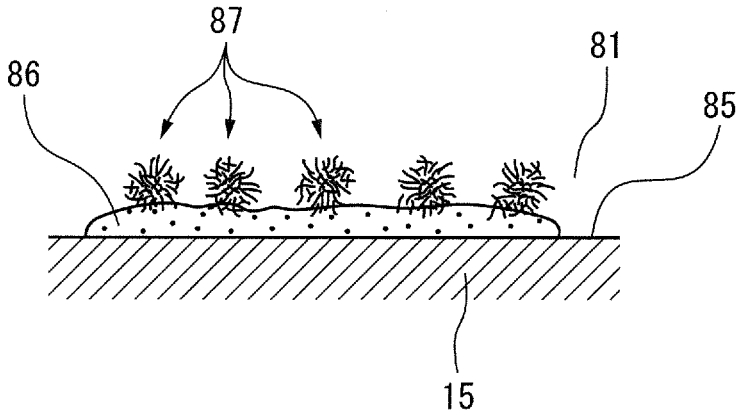
FIG. 8B is a view for explaining deposition of soot to the inner circumferential surfaces of nozzle holes.

FIG. 8B shows an enlarged cross-sectional view of the inner circumferential surface 85 of the nozzle hole 81. If the hydrocarbon feed valve 15 finishes injecting hydrocarbons, hydrocarbons will usually remain on the inner circumferential surface 85 of the nozzle hole 81 in the form of a liquid. At this time, the remaining liquid hydrocarbons are shown schematically by reference numeral 86 in FIG. 8B. On the other hand, when the hydrocarbon feed valve 15 injects hydrocarbons, if the exhaust gas around the openings of the nozzle holes 81 which open to the inside of the exhaust passage contains soot, at the time when the hydrocarbon feed valve 15 finishes injecting hydrocarbons, the soot will be sucked inside of the nozzle holes 81 and suck chamber 84 and the soot will deposit on the inner circumferential surfaces of the nozzle holes 81 and suck chamber 84. FIG. 8B schematically shows the soot which has deposited on the liquid hydrocarbons 86 on the inner circumferential surfaces 85 of the nozzle holes 81 at this time by the reference numerals 87.

Now then, if the soot 87 which is sucked inside of the nozzle holes 81 and suck chamber 84 contacts the liquid hydrocarbons 86, the pressure at the contact surfaces of the soot 87 and liquid hydrocarbons 86 will become lower than the pressure of the surroundings, so the soot 87 will be pushed toward the liquid hydrocarbons 86 and the soot 87 will be pulled by the interatomic force with the liquid hydrocarbons 86 toward the liquid hydrocarbons 86, so the soot 87 will be held in the state deposited such as shown in FIG. 8B. At this time, the deposition force of the soot 87 to the inner wall surfaces of the nozzle holes 81 and suck chamber 84 is weak. Therefore, if the action of injection of hydrocarbons is performed in such a state, the soot 87 which is deposited on the inner wall surfaces of the nozzle holes 81 and suck chamber 84 will immediately be blown off. Therefore, if the action of injection of hydrocarbons is performed at the time of such a state, the nozzle holes 81 will never clog.

On the other hand, as shown in FIG. 8B, if the state where the soot 87 is deposited on the liquid hydrocarbons 86 continues for a long time, the liquid hydrocarbons and the hydrocarbons in the liquid hydrocarbons which enter into the pores of the soot 87 will polymerize and gradually form polymers and will gradually become stronger in viscosity. If the liquid hydrocarbons 86 become higher in viscosity, the adhering force with respect to the inner wall surfaces of the nozzle holes 81 and suck chamber 84 will become stronger. If the viscosity of the liquid hydrocarbons which have entered the pores of the soot 87 becomes higher, the adhering force with the liquid hydrocarbons 86 will become stronger. That is, if the state of the soot 87 deposited on the liquid hydrocarbons 86 continues for a long time, the adhering force of the soot 87 with the inner wall surfaces of the nozzle holes 81 and suck chamber 84 will become stronger. If in this way the adhering force of the soot 87 with respect to the inner wall surfaces of the nozzle holes 81 and suck chamber 84 becomes stronger, even if the action of injecting hydrocarbons is performed, the soot 87 which deposits on the inner wall surfaces of the nozzle holes 81 and suck chamber 84 will remain adhered without being blown off. Therefore, in this case, the soot 87 will cause the nozzle holes 81 to clog.

In this case, to prevent the soot 87 from causing the nozzle holes 81 to clog, it is sufficient to inject hydrocarbons when the adhering force of the soot 87 to the inner wall surfaces of the nozzle holes 81 and suck chamber 84 is not that strong, that is, at the time of an adhering force of an extent where if injecting hydrocarbons, the soot 87 which is deposited on the inner wall surfaces of the nozzle holes 81 and suck chamber 84 will end up being blown off. In this case, if referring to the highest adhering force in the adhering force, under which the soot 87 deposited on the inner wall surfaces of the nozzle holes 81 and suck chamber 84 will not be blown off when hydrocarbons are injected, as the "limit adhering force", when the adhering force of the soot 87 is weaker than this limit adhering force, if the action of injecting hydrocarbons is performed, the soot 87 which is deposited on the inner wall surfaces of the nozzle holes 81 and suck chamber 84 will be blown off, while when the adhering force of the soot 87 becomes stronger than this limit adhering force, if the action of injecting hydrocarbons is performed, the soot 87 which is deposited on the inner wall surfaces of the nozzle holes 81 and suck chamber 84 will remain adhered without being blown off. Next, this limit adhering force will be explained while referring to FIG. 9 taking as an example the case where a certain fixed amount of soot 87 has deposited on the inner wall surfaces of the nozzle holes 81 and suck chamber 84.

Figure 9:
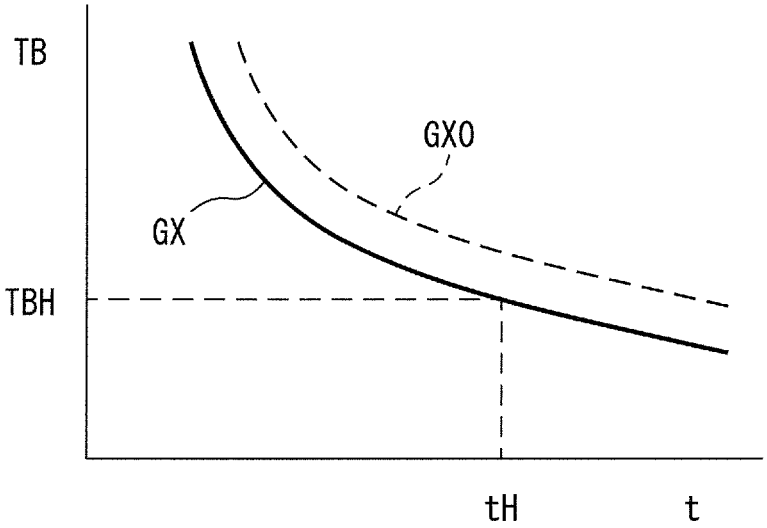
FIG. 9 is a view for explaining a relationship among a temperature and time until soot deposits etc.

This limit adhering force is shown in FIG. 9 by the broken line GXO. Note that, in FIG. 9, the ordinate TB shows the temperature of the front end face 80 of the hydrocarbon feed valve 15, while "t" shows the elapsed time from when the action of the hydrocarbon feed valve 15 injecting hydrocarbons is ended. The higher the temperature TB of the front end face 80 of the hydrocarbon feed valve 15, that is, the higher the temperatures of the inner wall surfaces of the nozzle holes 81 and suck chamber 84, the more the action of polymerization of the liquid hydrocarbons 86 and the action of polymerization of the hydrocarbons in the liquid hydrocarbons which enter the pores of the soot 87 progress and the more rapidly the viscosity becomes stronger. Therefore, the higher the temperature TB of the front end face 80 of the hydrocarbon feed valve 15, the faster the degree of adherence to the inner wall surfaces of the nozzle holes 81 and suck chamber 84 rises and the shorter the elapsed time "t" from when the action of the hydrocarbon feed valve 15 injecting hydrocarbons is ended until when the adhering force becomes the limit adhering force GXO. Therefore, as shown in FIG. 9, the higher the temperature TB of the front end face 80 of the hydrocarbon feed valve 15, the shorter the elapsed time "t" by which the adhering force reaches the limit adhering force GXO.

In this embodiment according to the present invention, an allowable adherence degree GX with a degree of adherence which is somewhat weaker than the limit adhering force GXO is set in advance. When the degree of adherence reaches the limit of this allowable adherence degree GX, the hydrocarbon feed valve 15 injects hydrocarbons to blow off the soot 87 which has deposited on the inner wall surfaces of the nozzle holes 81 and suck chamber 84. Next, one example of the method of calculation of this degree of adherence will be explained. Now then, in FIG. 9, in case where the temperature TB of the front end face 80 of the hydrocarbon feed valve 15 is TBH, if the time tH has elapsed after the injection of hydrocarbons from the hydrocarbon feed valve 15 is performed, the degree of adherence reaches the limit of the allowable adherence degree GX. Therefore, if assuming that the temperature TB of the front end face 80 of the hydrocarbon feed valve 15 was TBH over the ΔT time period, it can be considered at this time that the degree of adherence advanced toward the limit of the allowable adherence degree GX by exactly ΔT/tH percent. Therefore, when calculating the value of ΔT/tH for the successively changing temperatures TB of the front end face 80 of the hydrocarbon feed valve 15 and cumulatively adding the calculated values of ΔT/tH, it is possible to judge that the degree of adherence reaches the limit of the allowable adherence degree GX when the cumulative value becomes 100%.

Note that, in this case, the allowable adherence degree GX changes in accordance with the amount of soot 87 which deposits on the inner wall surfaces of the nozzle holes 81 and suck chamber 84 when the hydrocarbon feed valve 15 last injected hydrocarbons. That is, the greater the amount of soot 87 which deposits on the inner wall surfaces of the nozzle holes 81 and suck chamber 84 when the hydrocarbon feed valve 15 last injected fuel, the more the amount of soot 87 which is polymerized increases, so the degree of adherence reaches the limit of the allowable adherence degree GX at an early timing. Therefore, the greater the amount of soot 87 which deposits on the inner wall surfaces of the nozzle holes 81 and suck chamber 84 at the time of the last injection from the hydrocarbon feed valve 15, the lower the curve which shows the limit of the allowable adherence degree becomes positioned as shown in FIG. 9. In this embodiment according to the present invention, the allowable adherence degrees GX corresponding to the amount of soot 87 which is deposited at the inner wall surfaces of the nozzle holes 81 and suck chamber 84 when hydrocarbons were last injected from the hydrocarbon feed valve 15 are stored in advance as functions of the temperature TB of the front end face 80 of the hydrocarbon feed valve 15 and the elapsed time "t" from when the hydrocarbons were injected from the hydrocarbon feed valve 15.

Note that, as explained above, soot 87 deposits on the inner wall surfaces of the nozzle holes 81 and suck chamber 84 because soot is sucked into the nozzle holes 81 and suck chamber 84 when the hydrocarbon feed valve 15 finishes injecting hydrocarbons. If, at the time of end of injection of hydrocarbons from the hydrocarbon feed valve 15, the exhaust gas around the openings of the nozzle holes 81 which open to the exhaust passage does not contain soot, that is, if making the hydrocarbon feed valve 15 inject hydrocarbons when the exhaust gas around the openings of the nozzle holes 81 which open to the exhaust passage does not contain soot, soot will not be sucked inside of the nozzle holes 81 and soot will no longer deposit on the inner wall surfaces of the nozzle holes 81 and suck chamber 84. If soot does not deposit on the inner wall surfaces of the nozzle holes 81 and suck chamber 84, clogging will not occur and there is no longer a need to blow off soot which deposits on the inner wall surfaces of the nozzle holes 81 and suck chamber 84 by injecting hydrocarbons from the hydrocarbon feed valve 15.

For example, if the feed of fuel to the inside of the combustion chamber 2 is stopped, the engine will not discharge any soot at all. Therefore, at this time, there is no soot present at all in the exhaust gas around the openings of the nozzle holes 81 into the exhaust passage. Therefore, if, at this time, clogging prevention hydrocarbons are injected from the hydrocarbon feed valve 15, the soot which deposits on the inner wall surfaces of the nozzle holes 81 and suck chamber 84 is blown off at the time of start of injection, but the soot is never sucked inside the nozzle holes 81 at the time of end of injection and the soot never deposits on the inner circumferential surfaces of the nozzle holes 81 and suck chamber 84. Therefore, in this case, it is no longer necessary to inject hydrocarbons from the hydrocarbon feed valve 15 so as to blow off the soot which deposited on the inner circumferential surfaces of the nozzle holes 81 and suck chamber 84.

Figure 10:
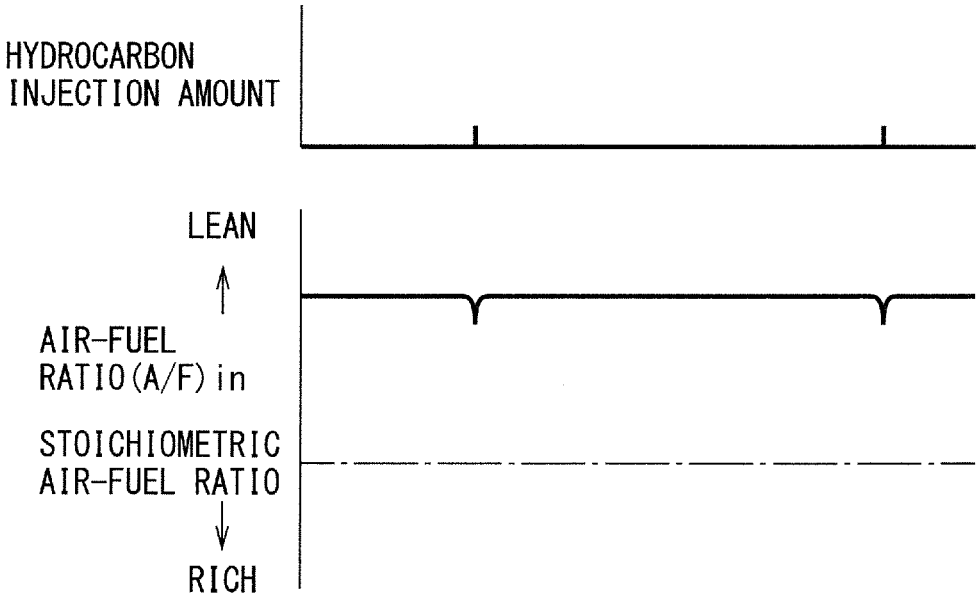
FIG. 10 is a time chart for explaining clogging prevention injection.

Note that, the amount of injection of clogging prevention hydrocarbons at this time need only be an amount of hydrocarbons of an extent filling the entire volumes of the nozzle holes 81 and suck chamber 84 when starting injection. Therefore, in this embodiment according to the present invention, the amount of injection of clogging prevention hydrocarbons is made an amount which fills the entire volumes of the nozzle holes 81 and suck chamber 84. FIG. 10 shows the changes in the air-fuel ratio (A/F) in of the exhaust gas when injecting the clogging prevention hydrocarbons. From FIG. 10, it will be understood that the air-fuel ratio (A/F) in of the exhaust gas at this time does not change much at all.

Figure 11:
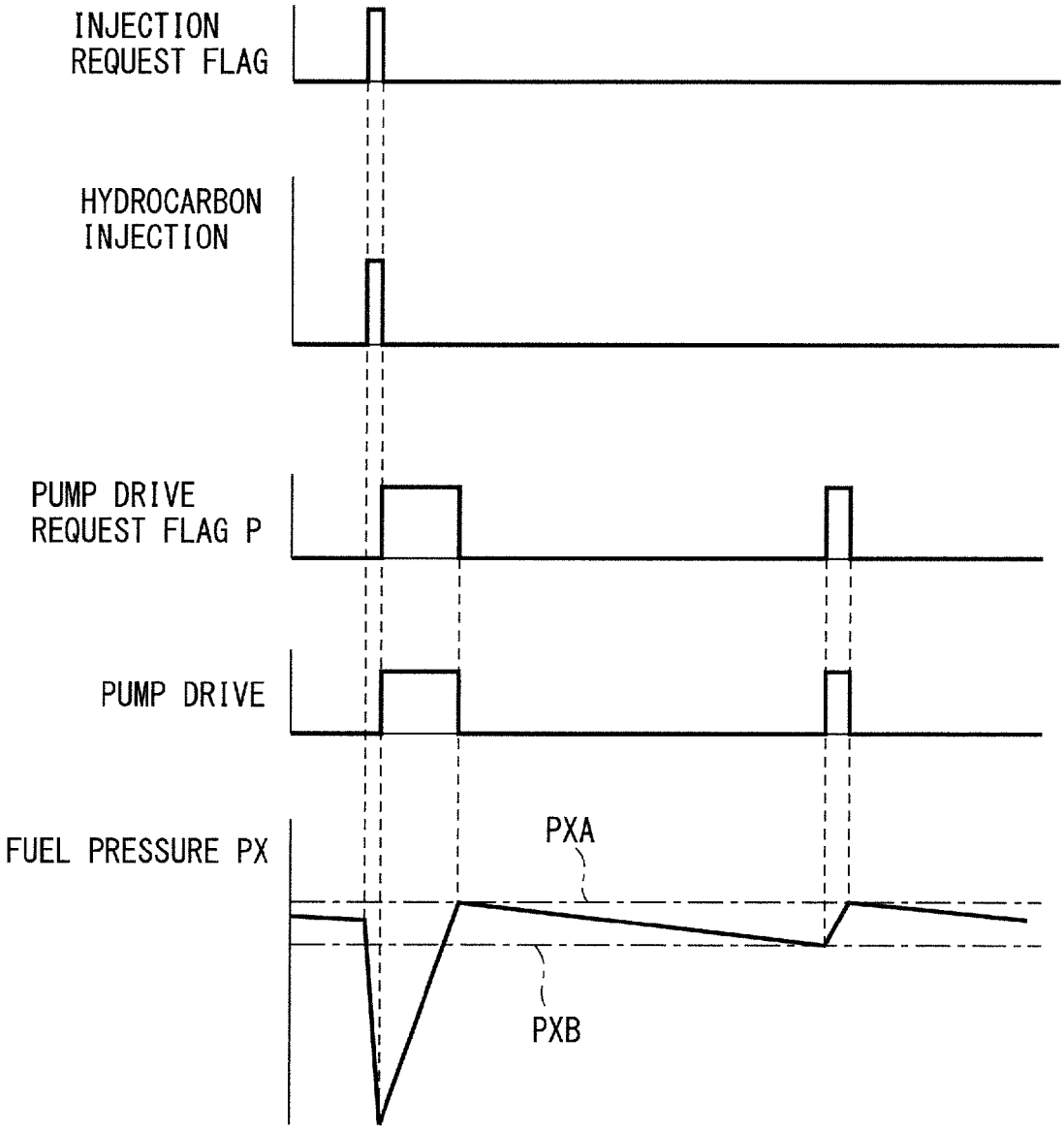
FIG. 11 is a time chart for explaining a relationship among changes in an injection request, a pump driving request, and a fuel pressure PX.

Now then, if again returning to the discussion of the boosting action of the fuel pressure PX by the booster pump 60, FIG. 11 shows the changes in the injection request flag which requests injection of hydrocarbons from the hydrocarbon feed valve 15, the actual injection state of hydrocarbons, the pump drive request flag P for requesting drive of the pressurizing piston 62 by the actuator 63, the actual pump operating state, and the fuel pressure PX of the fuel which is fed to the hydrocarbon feed valve 15. As shown in FIG. 11, if the injection request flag is set, the injection of the hydrocarbons from the hydrocarbon feed valve 15 is performed while the injection request flag is set. During this time, the fuel pressure PX of the fuel which is fed to the hydrocarbon feed valve 15 rapidly falls.

If the injection of the hydrocarbons from the hydrocarbon feed valve 15 is completed, the pump drive request flag P is set and the booster pump 60 is driven until the fuel pressure PX reaches the target fuel pressure PXA. If the fuel pressure PX reaches the target fuel pressure PXA, the pump drive request flag P is reset. Due to this, the booster pump 60 stops being driven. Next, the fuel pressure PX gradually falls. If the fuel pressure PX reaches the allowable lower limit fuel pressure PXB, the pump drive request flag P is set. As a result, the booster pump 60 is driven. Next, if the fuel pressure PX rises to the target fuel pressure PXA, the pump drive request flag P is reset, and the booster pump 60 stops being driven.

In this regard, in this embodiment according to the present invention, as shown in FIG. 5, when $NO_X$ should be released from the exhaust purification catalyst 13, the air-fuel ratio (A/F) in of the exhaust gas which flows into the exhaust purification catalyst 13 is made temporarily rich. In this case, as explained above, the air-fuel ratio (A/F) in of the exhaust gas flowing into the exhaust purification catalyst 13 is made temporarily rich by injecting hydrocarbons from the hydrocarbon feed valve 15 only in a particular operating state where the air-fuel ratio of the combustion gas in the combustion chamber 2 cannot be made rich. Further, when using the first $NO_X$ removal method to remove the $NO_X$, as shown in FIG. 6A, hydrocarbons are injected from the hydrocarbon feed valve 15 by a short period.

On the other hand, when performing the action of raising the temperature of the particulate filter 14 so as to regenerate the particulate filter 14, as shown in FIG. 6B, hydrocarbons are injected from the hydrocarbon feed valve 15 by a short period while maintaining the air-fuel ratio (A/F) in of the exhaust gas flowing into the exhaust purification catalyst 13 lean. Further, in case where the $SO_x$ stored in the exhaust purification catalyst 13 is made to be released from the exhaust purification catalyst 13, when performing the action of raising the temperature of the exhaust purification catalyst 13, as shown in FIG. 6B, hydrocarbons are injected from the hydrocarbon feed valve 15 by a short period while maintaining the air-fuel ratio (A/F) in of the exhaust gas flowing into the exhaust purification catalyst 13 lean. Furthermore, as shown in FIG. 10, hydrocarbons are injected from the hydrocarbon feed valve 15 to prevent clogging of the nozzle holes 81 of the hydrocarbon feed valve 15.

In this way, in this embodiment according to the present invention, hydrocarbons are injected from the hydrocarbon feed valve 15 for various purposes. In these cases, an extremely high precision is requested for the amount of injection of hydrocarbons per injection when using the first $NO_X$ removal method to remove $NO_X$ and when performing the action of raising the temperature of the particulate filter 14 or the exhaust purification catalyst 13. That is, the amount of injection of hydrocarbons per injection when using the first $NO_X$ removal method to remove $NO_X$ is relatively small. Therefore, a slight deviation of the injection amount with respect to the optimal amount of injection of hydrocarbons per injection can have a great effect on the rate of removal of $NO_X$ and slip through of hydrocarbons. Further, the amount of injection of hydrocarbons per injection when performing the action of raising the temperature of the particulate filter 14 or the exhaust purification catalyst 13 is also relatively small. Therefore, a slight deviation of the injection amount with respect to the optimal amount of injection of hydrocarbons per injection can have a great effect on the action of raising the temperature of the particulate filter 14 or the exhaust purification catalyst 13 and slip through of hydrocarbons. Therefore, when using the first $NO_X$ removal method to remove $NO_X$ and when performing the action of raising the temperature of the particulate filter 14 or the exhaust purification catalyst 13, it is necessary to prevent the amount of injection of hydrocarbons per injection from deviating from the optimal amount of injection of hydrocarbons per injection.

In this regard, as explained above, when using the first $NO_X$ removal method to remove $NO_X$ and when performing the action of raising the temperature of the particulate filter 14 or the exhaust purification catalyst 13, the amount of injection W (mg) of hydrocarbons per injection is calculated from the map which is shown in FIG. 7C. In this case, the hydrocarbon injection time which is required for injecting the calculated amount of injection W (g) of hydrocarbons is calculated based on the fuel pressure PX at the time of start of injection. Therefore, if the fuel pressure PX changes after the start of injection, the amount of injection of hydrocarbons which is actually injected deviates from the optimal amount of injection W (mg) which is calculated from the map. As a result, problems will arise in that the $NO_X$ removal rate falls, the amount of slip through of hydrocarbons increases, and the temperature of the particulate filter 14 or the exhaust purification catalyst 13 is not quickly raised to the target temperature.

The fuel pressure PX greatly changes during injection of hydrocarbons when a boosting action of the fuel pressure PX by the booster pump 60 is being performed. Therefore, when using the first $NO_X$ removal method to remove $NO_X$ and when performing the action of raising the temperature of the particulate filter 14 or the exhaust purification catalyst 13, it is necessary to prevent the injection of hydrocarbons from the hydrocarbon feed valve 15 and the boosting action of the fuel pressure PX by the booster pump 60 from overlapping.

As opposed to this, the amount of injection of hydrocarbons which is injected per injection for preventing clogging is an extremely small amount. Therefore, even if the amount of injection of hydrocarbons which is injected per injection for preventing clogging deviates somewhat, there is no adverse effect. At this time, to change the injection timing of hydrocarbons for preventing clogging so that the injection of hydrocarbons for preventing clogging and the boosting action of the fuel pressure PX by the booster pump 60 do not overlap, complicated control becomes required and no merit is gained. Therefore, in the present invention, the boosting action of the fuel pressure PX by the booster pump 60 and the injection of hydrocarbons for preventing clogging are made to be respectively independently controlled and the overlap of the injection of hydrocarbons for preventing clogging and the boosting action of the fuel pressure PX by the booster pump 60 is made to be allowed.

On the other hand, when the second $NO_X$ removal method is being used, sometimes the hydrocarbon feed valve 15 is made to inject hydrocarbons so as to make the stored $NO_X$ be released from the exhaust purification catalyst 13. The amount of injection of hydrocarbons in this case is an extremely great amount as will be understood from FIG. 5. Therefore, in this case, if the booster pump 60 is made to stop when hydrocarbons are being injected, the fuel pressure PX will end up falling during the injection action of hydrocarbons. As a result, the problem arises that good atomization of the injected fuel can no longer be secured. In this case, to secure good atomization of the injected fuel, it is necessary to prevent the fuel pressure PX from falling during injection of hydrocarbons as much as possible. For that reason, it becomes necessary to continue the boosting action of the fuel pressure PX by the booster pump 60 while injecting hydrocarbons. Therefore, in this embodiment according to the present invention, when hydrocarbons are injected from the hydrocarbon feed valve 15 to release the stored $NO_X$ from the exhaust purification catalyst 13, the boosting action of the fuel pressure PX by the booster pump 60 is made to continue while injecting hydrocarbons.

In this regard, the present invention can be applied even when using a reducing agent constituted by hydrocarbons and even when using a reducing agent constituted by a urea aqueous solution. Therefore, if calling the feed valve for feeding hydrocarbons or a urea aqueous solution a reducing agent feed valve 15, in the present invention, in a control system of an internal combustion engine comprising a reducing agent feed valve 15 arranged in an engine exhaust passage, an $NO_X$ purification device 13 which removes $NO_X$ by a reducing agent injected from the reducing agent feed valve 15, and a booster device 60 for boosting an injection pressure of a reducing agent injected from the reducing agent feed valve 15, an $NO_X$ removal injection of injection of a reducing agent from the reducing agent feed valve 15 which is repeatedly performed within a predetermined range of period so as to remove $NO_X$, that is, an $NO_X$ removal injection when using the first $NO_X$ removal method to remove $NO_X$, and a clogging prevention injection of injection of the reducing agent from the reducing agent feed valve 15 which is made smaller in amount of injection compared with the $NO_X$ removal injection for preventing clogging of nozzle holes 81 of the reducing agent feed valve 15 are performed. In this case, in accordance with the purpose of injection of hydrocarbons from the hydrocarbon feed valve 15, injection of hydrocarbons from the hydrocarbon feed valve 15 and the boosting action of fuel pressure PX by the booster pump 60 are controlled related with each other or respectively independently.

Next, while referring to FIG. 12 to FIG. 16 which show changes in the injection request flag which requests injection of hydrocarbons from the hydrocarbon feed valve 15 (in FIG. 16, injection command), actual injection state of hydrocarbons, pump drive request flag P for requesting drive of the pressurizing piston 62 by the actuator 63, actual pump drive state, and fuel pressure PX of the fuel which is fed to the hydrocarbon feed valve 15 in the same way as FIG. 11, a preferred embodiment of injection control and boosting control in accordance with the purpose of injection of hydrocarbons from the hydrocarbon feed valve 15 will be explained.

Figure 12:
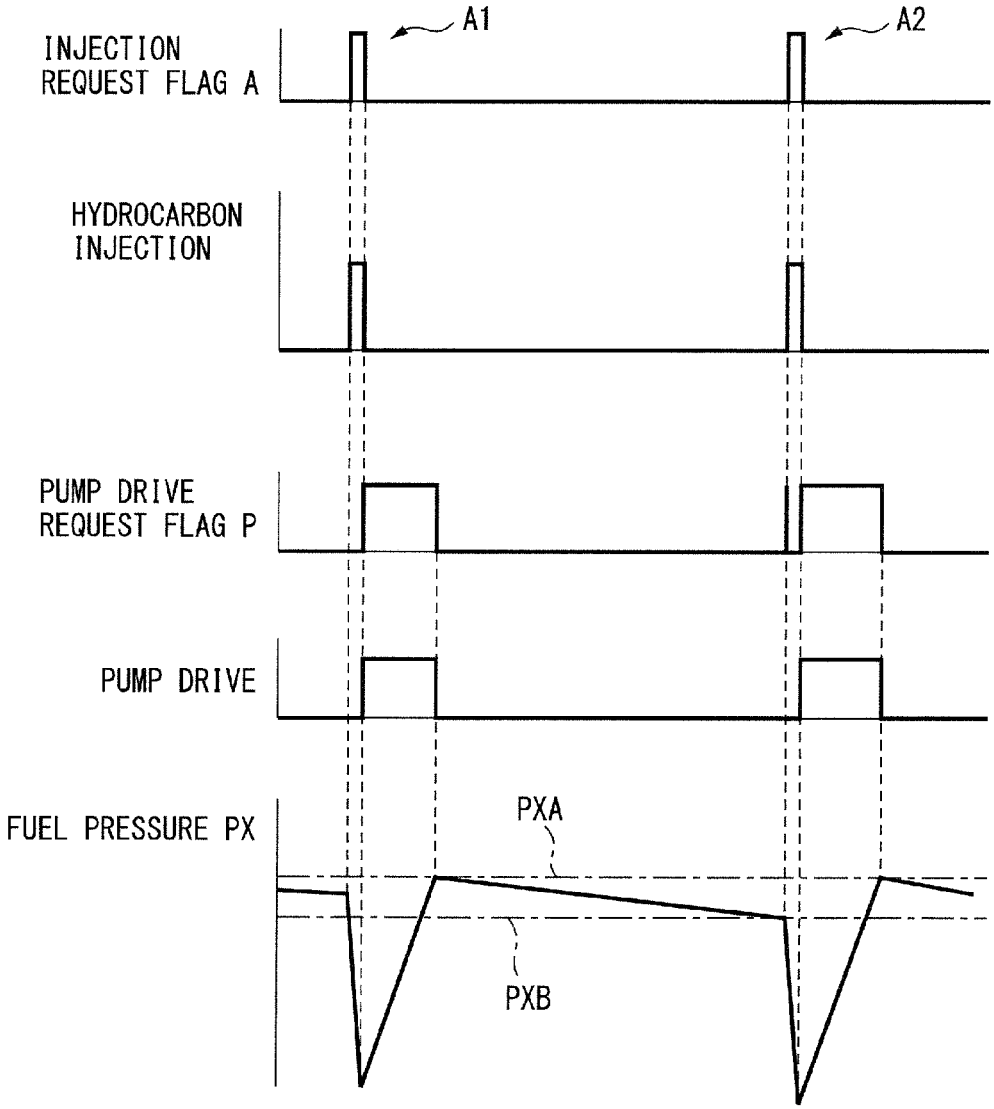
FIG. 12 is a time chart for explaining a relationship among changes in an injection request, a pump driving request, and a fuel pressure PX.

First, referring to FIG. 12, an injection request flag A in FIG. 12 shows a flag which is set when injection of hydrocarbons from the hydrocarbon feed valve 15 is requested for using the first $NO_X$ removal method to remove $NO_X$ or when injection of hydrocarbons from the hydrocarbon feed valve 15 is requested for performing the action of raising the temperature of the particulate filter 14 or the exhaust purification catalyst 13. Now then, as shown by A1 in FIG. 12, when the injection request flag A is set when the boosting action of the fuel pressure PX by the booster pump 60 is not being performed, the injection of the hydrocarbons from the hydrocarbon feed valve 15 is immediately performed. When the injection of the hydrocarbons from the hydrocarbon feed valve 15 is completed, the pump drive request flag P is set and the booster pump 60 is driven. The same is true in the case which is shown by A1 in FIG. 13 and FIG. 14.

As opposed to this, A2 of FIG. 12 shows the case where the injection request flag A and the pump drive request flag P are simultaneously set, that is, the case where the injection request and the pump drive request are simultaneously made. In this case, the pump drive request flag P is reset, that is, the pump drive request is withdrawn, and the injection request flag A is maintained in the state as set. Therefore, at this time, the injection of the hydrocarbons from the hydrocarbon feed valve 15 is performed in a state where the booster pump 60 is stopped. Next, if the injection of the hydrocarbons from the hydrocarbon feed valve 15 is completed, the pump drive request flag P is set and the booster pump 60 is driven.

Figure 13:
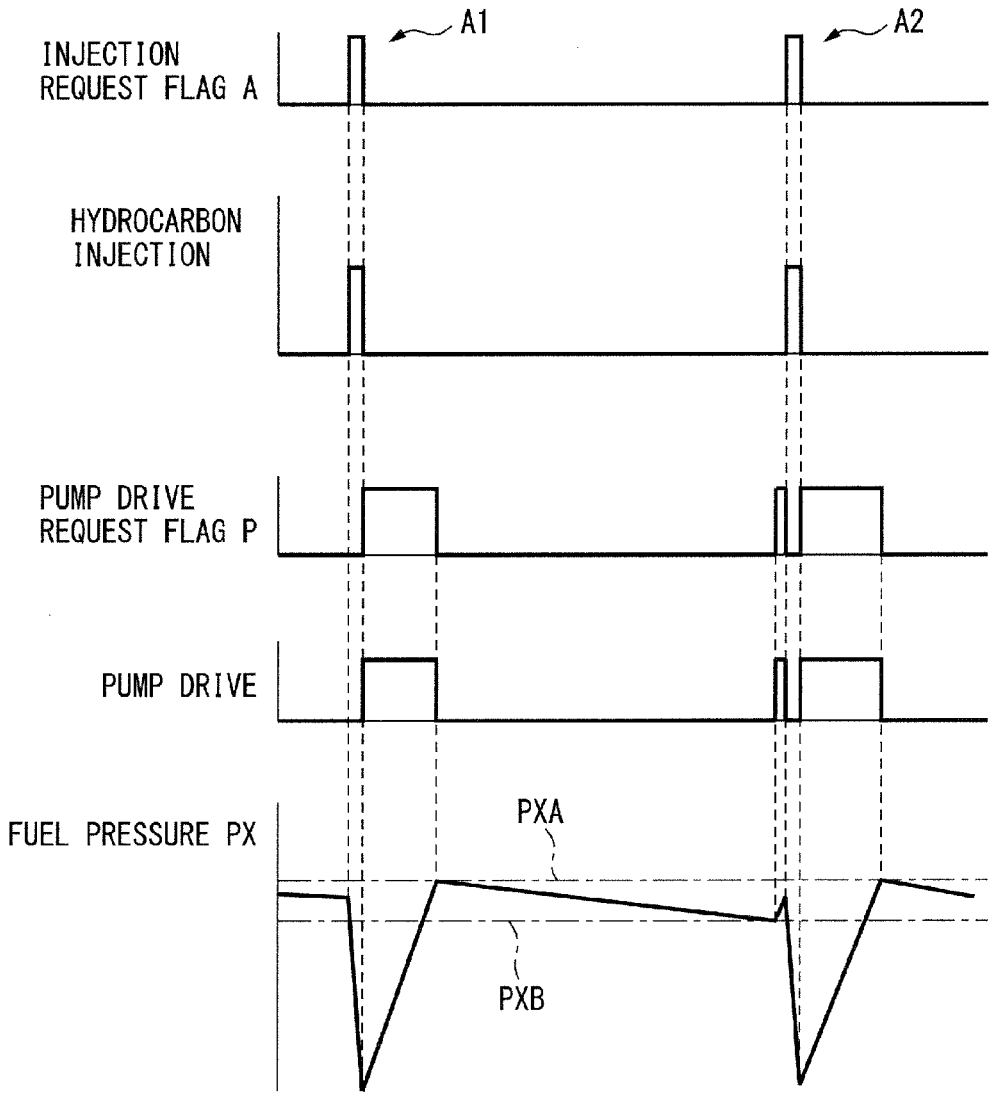
FIG. 13 is a time chart for explaining a relationship among changes in an injection request, a pump driving request, and a fuel pressure PX.

On the other hand, A2 of FIG. 13 shows the case where the injection request flag A is set when the pump drive request flag P is set and the boosting action of the fuel pressure PX by the booster pump 60 is being performed. In this case, if the injection request flag A is set, the pump drive request flag P is reset and the injection request flag A is maintained as is in the set state. Therefore, at this time, the booster pump 60 stops being driven and the injection of the hydrocarbons from the hydrocarbon feed valve 15 is performed in the state where the booster pump 60 is stopped. Next, if the injection of the hydrocarbons from the hydrocarbon feed valve 15 is completed, the pump drive request flag P is set and the booster pump 60 is driven.

Figure 14:
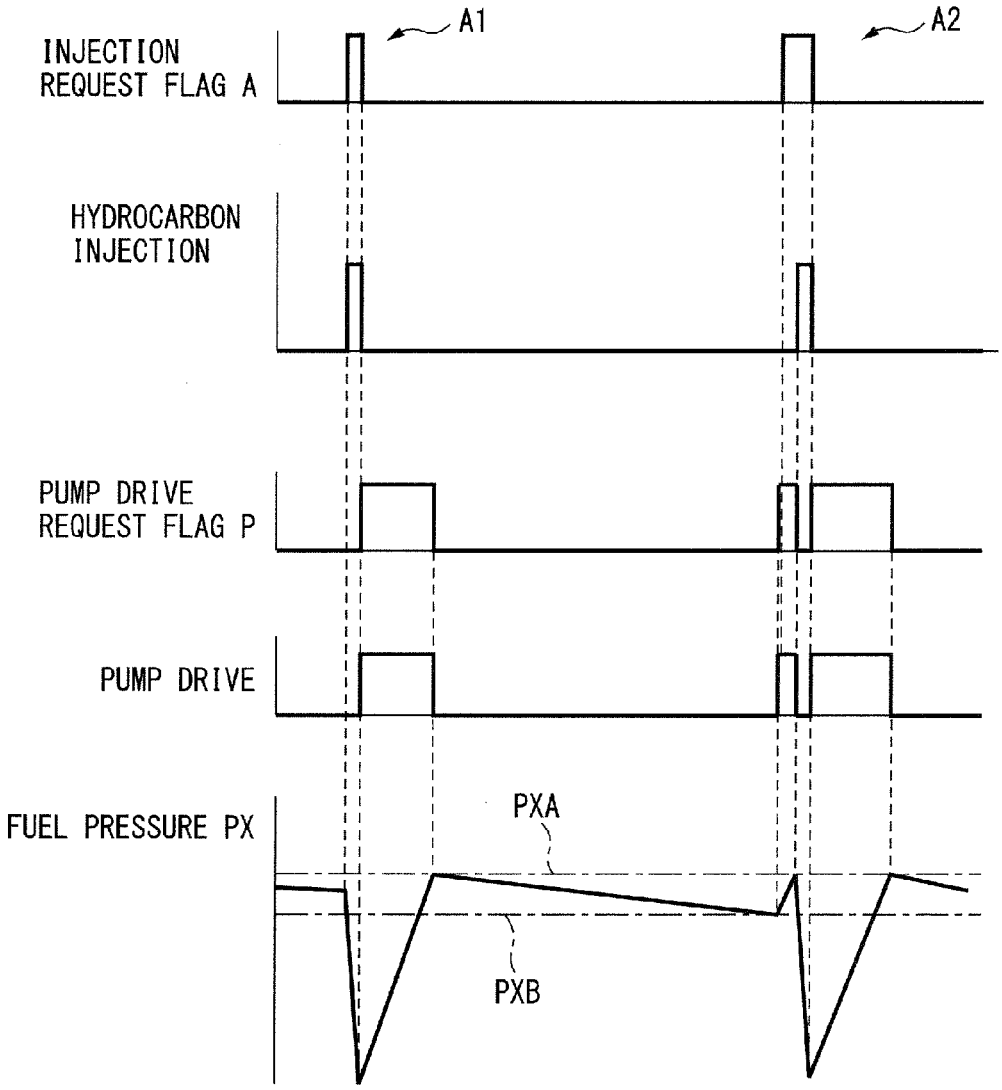
FIG. 14 is a time chart for explaining a relationship among changes in an injection request, a pump driving request, and a fuel pressure PX.

On the other hand, A2 of FIG. 14, in the same way as the case which is shown by A2 of FIG. 13, shows the case where the injection request flag A is set when the pump drive request flag P is set and the boosting action of the fuel pressure PX by the booster pump 60 is being performed. However, in this case, in the embodiment which is shown in FIG. 14, unlike the embodiment which is shown in FIG. 13, the boosting action of the fuel pressure PX by the booster pump 60 is continued and the injection of hydrocarbons is started when the fuel pressure PX reaches the target fuel pressure PXA and the booster pump 60 stops being driven. Next, when the injection of the hydrocarbons from the hydrocarbon feed valve 15 is completed, the pump drive request flag P is set and the booster pump 60 is driven.

In this way, as shown in FIG. 12 to FIG. 14, in the present invention, the $NO_X$ removal injection of the injection of reducing agent from the reducing agent feed valve 15 which is repeatedly performed for removing $NO_X$ within a predetermined range of period, that is, the $NO_X$ removal injection when using the first $NO_X$ removal method to remove $NO_X$, and the boosting action of the injection pressure PX by the booster device 60 are controlled so that the $NO_X$ removal injection and the boosting action of the injection pressure PX by the booster device 60 are not simultaneously performed. In this case, in the embodiment which are shown in FIG. 12 and FIG. 13, when the request for boosting the injection pressure PX by the booster device 60 and the request for $NO_X$ removal injection overlap, the boosting action of the injection pressure PX by the booster device 60 is put off and the $NO_X$ removal injection is performed with priority. The boosting action of the injection pressure PX by the booster device 60 is started or resumed after the completion of the $NO_X$ removal injection.

On the other hand, as explained above, the injection request flag A is set when injection of hydrocarbons from the hydrocarbon feed valve 15 is requested for performing the action of raising the temperature of the particulate filter 14 or the exhaust purification catalyst 13. Therefore, in this embodiment according to the present invention, in addition to $NO_X$ removal injection, temperature raising injection of injection of the reducing agent from the reducing agent feed valve 15 which is repeatedly performed for making the exhaust treatment device arranged in the engine exhaust passage rise in temperature is performed. This temperature raising injection and the boosting action of the injection pressure PX by the booster device 60 are controlled so that this temperature raising injection and boosting action of the injection pressure PX by the booster device 60 are not performed simultaneously. In this case, in the embodiment which is shown in FIG. 12 and FIG. 13, when the request for boosting the injection pressure PX by the booster device 60 and the request for temperature raising injection overlap, the boosting action of the injection pressure PX by the booster device 60 is put off and the temperature raising injection is performed with priority. The boosting action of the injection pressure PX by the booster device 60 is started or resumed after the completion of the temperature raising injection. Note that, the above-mentioned exhaust treatment device shows the particulate filter 14 or the $NO_X$ purification device 13.

As opposed to this, in the embodiment which is shown in FIG. 14, when the request for boosting the injection pressure PX by the booster device 60 and the request for $NO_X$ removal injection overlap, the $NO_X$ removal injection is put off and the boosting action of the injection pressure PX by the booster device 60 is performed with priority. The $NO_X$ removal injection is started after the completion of the boosting action of the injection pressure PX by the booster device 60. Further, in this embodiment, in case where temperature raising injection is performed for making the exhaust purification device rise in temperature in addition to $NO_X$ removal injection, when the request for boosting the injection pressure PX by the booster device 60 and the request for temperature raising injection overlap, the temperature raising injection is put off and the boosting action of the injection pressure PX by the booster device 60 is performed with priority. The temperature raising injection is started after the completion of the boosting action of the injection pressure PX by the booster device 60.

Note that, as shown in FIG. 14, when the boosting action of the injection pressure PX by the booster device 60 is performed with priority, that is, when the injection timing of hydrocarbons which is shown in A2 is delayed from the already calculated injection timing, the injection density DX of hydrocarbons becomes lower than the injection density DX of hydrocarbons which is already found from the map which is shown in FIG. 7A and therefore it is necessary to increase the amount of injection of hydrocarbons by exactly the decline in injection density DX of hydrocarbons. The same is true for the injection density DY of hydrocarbons which is shown in FIG. 7B. Therefore, as shown in FIG. 14, when the boosting action of the injection pressure PX by the booster device 60 is performed with priority and therefore the injection interval of $NO_X$ removal injection or the injection interval of temperature raising injection is made to increase, the amount of injection of $NO_X$ removal injection or the amount of injection of temperature raising injection is increased by exactly the ratio of increase of the injection interval. Specifically speaking, the injection densities DX, DY of hydrocarbons at the time of injection of hydrocarbons which is shown by A2 are increased by exactly the ratio of increase of the injection interval. The amount of injection per injection is recalculated from the increased injection densities DX, DY.

Figure 15:
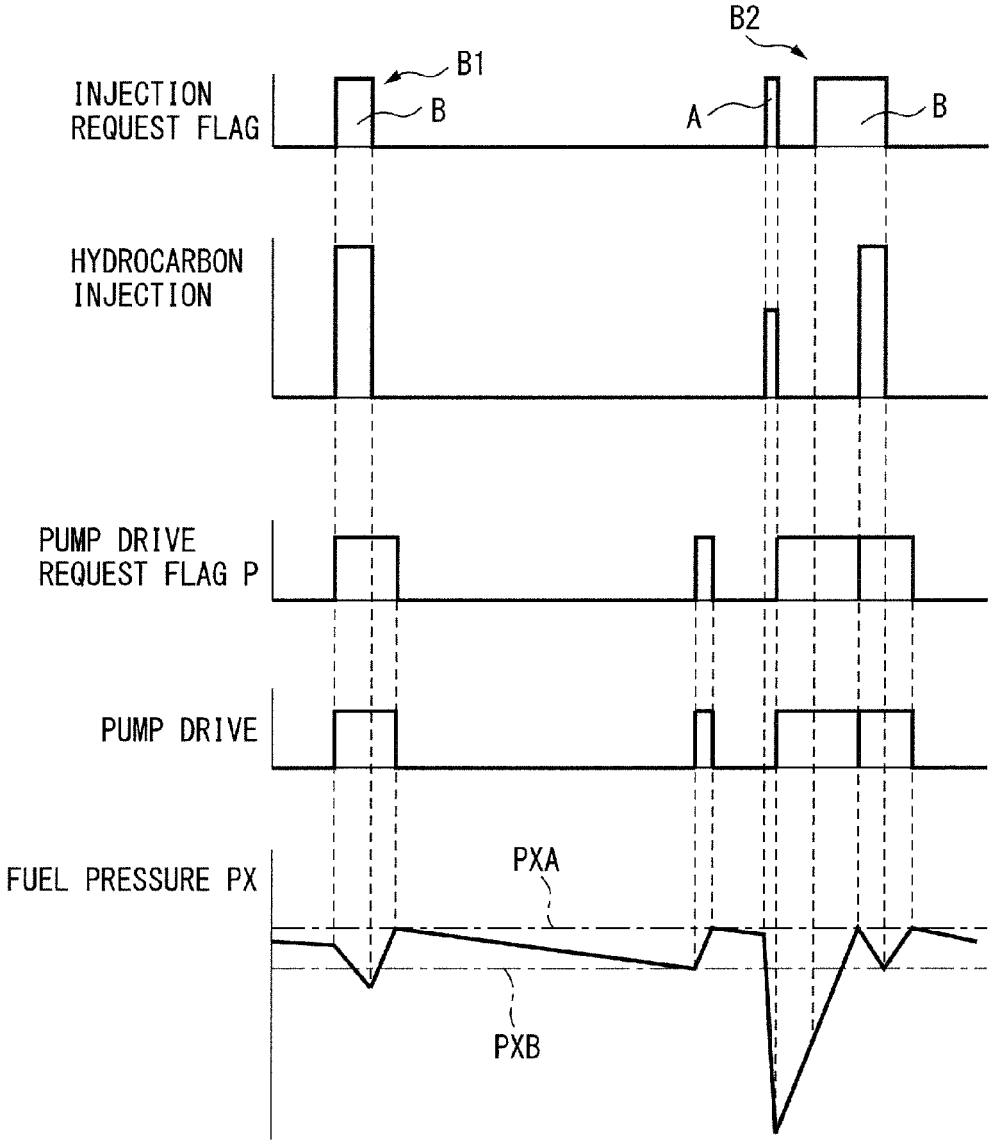
FIG. 15 is a time chart for explaining a relationship among changes in an injection request, a pump driving request, and a fuel pressure PX.

FIG. 15 shows the case of the hydrocarbon feed valve 15 injecting hydrocarbons so that the air-fuel ratio (A/F) in of the exhaust gas flowing into the exhaust purification catalyst 13 is made temporarily rich when $NO_X$ should be released from the exhaust purification catalyst 13. Note that, in FIG. 15, an injection request flag B shows a flag which is set when the hydrocarbon feed valve 15 is requested to inject hydrocarbons when $NO_X$ should be released from the exhaust purification catalyst 13. Further, FIG. 15 also shows the injection request flag A which is set when injection of hydrocarbons from the hydrocarbon feed valve 15 is requested for using the first $NO_X$ removal method to remove $NO_X$ or when injection of hydrocarbons from the hydrocarbon feed valve 15 is requested for performing the action of raising the temperature of the particulate filter 14 or the exhaust purification catalyst 13.

B1 in FIG. 15 shows the case where the injection request flag B is set when the boosting action of the fuel pressure PX by the booster pump 60 is not being performed. In this case, as shown in FIG. 15, if the injection request flag B is set, the injection of the hydrocarbons from the hydrocarbon feed valve 15 is immediately performed and, simultaneously, the pump drive request flag P is set and the booster pump 60 is driven. Next, while the injection request flag B is set, the action of injection of hydrocarbons from the hydrocarbon feed valve 15 is continued. Next, if the injection request flag B is reset, the injection of the hydrocarbons from the hydrocarbon feed valve 15 is stopped, but the pump drive request flag P continues to be set. Even if the injection of the hydrocarbons from the hydrocarbon feed valve 15 is stopped in this way, the pump drive request flag P continues to be set, so the booster pump 60 continues to be driven. If the fuel pressure PX reaches the target fuel pressure PXA, the injection request flag B is reset and the booster pump 60 stops being driven.

The amount of injection of hydrocarbons which are injected when $NO_X$ should be released from the exhaust purification catalyst 13 is extremely large. In this case, to secure good atomization of the injected fuel, as explained above, it is necessary that the fuel pressure PX be prevented from falling as much as possible while injecting hydrocarbons. For this reason, it becomes necessary to continue the boosting action of the fuel pressure PX by the booster pump 60 while injecting hydrocarbons. Therefore, in this embodiment according to the present invention, as shown by B1 in FIG. 15, when injecting hydrocarbons from the hydrocarbon feed valve 15 so as to release the stored $NO_X$ from the exhaust purification catalyst 13, the boosting action of the fuel pressure PX by the booster pump 60 is made to continue while injecting hydrocarbons.

That is, in this embodiment according to the present invention, the $NO_X$ purification device 13 is comprised of an $NO_X$ storage catalyst which can store $NO_X$, $NO_X$ release-use injection of injection of the reducing agent from the storage catalyst feed valve 15 which is performed for releasing the $NO_X$ stored in the $NO_X$ storage catalyst 13 from the $NO_X$ storage catalyst 13 is performed, and, when $NO_X$ release-use injection is performed, the boosting action of the fuel pressure PX by the booster pump 60 is simultaneously performed.

On the other hand, B2 in FIG. 15 shows the case where the injection request flag B is set when the pump drive request flag P is set and the boosting action of the fuel pressure PX by the booster pump 60 is being performed. In this case, even if the injection request flag B is set, the injection of the hydrocarbons from the hydrocarbon feed valve 15 is not performed, and the pump drive request flag P is maintained as set. When the fuel pressure PX reaches the target fuel pressure PXA, the hydrocarbon feed valve 15 starts injecting hydrocarbons. Even if the hydrocarbon feed valve 15 starts injecting hydrocarbons, the pump drive request flag P remains as set. Next, the injection request flag B is reset. Even if the injection of the hydrocarbons from the hydrocarbon feed valve 15 is stopped, the pump drive request flag P continues to be set. Since, in this way, even if the injection of the hydrocarbons from the hydrocarbon feed valve 15 is stopped, the pump drive request flag P continues to be set, the booster pump 60 continues to be driven. If the fuel pressure PX reaches the target fuel pressure PXA, the injection request flag B is reset and the booster pump 60 stops being driven.

The amount of injection of hydrocarbons which is injected when $NO_X$ should be released from the exhaust purification catalyst 13 is extremely large. In this case, to secure good atomization of the injected fuel, it is preferable to raise the fuel pressure PX at the time of injection start to be as high as possible and to prevent the fuel pressure PX from falling as much as possible during injection of hydrocarbons. Therefore, as shown by B2 in FIG. 15, when the boosting action of the fuel pressure PX by the booster pump 60 is being performed, if the injection request flag B is set, the injection of hydrocarbons from the hydrocarbon feed valve 15 is started when the fuel pressure PX reaches the target fuel pressure PXA. In this way, in this embodiment according to the present invention, if the boosting action of the fuel pressure PX by the booster pump 60 is being performed when there is a request for $NO_X$ release-use injection, the $NO_X$ release-use injection is not performed until the injection pressure PX reaches the predetermined target injection pressure PXA and the $NO_X$ release-use injection is started after the injection pressure PX reaches the predetermined target injection pressure PXA.

Figure 16:
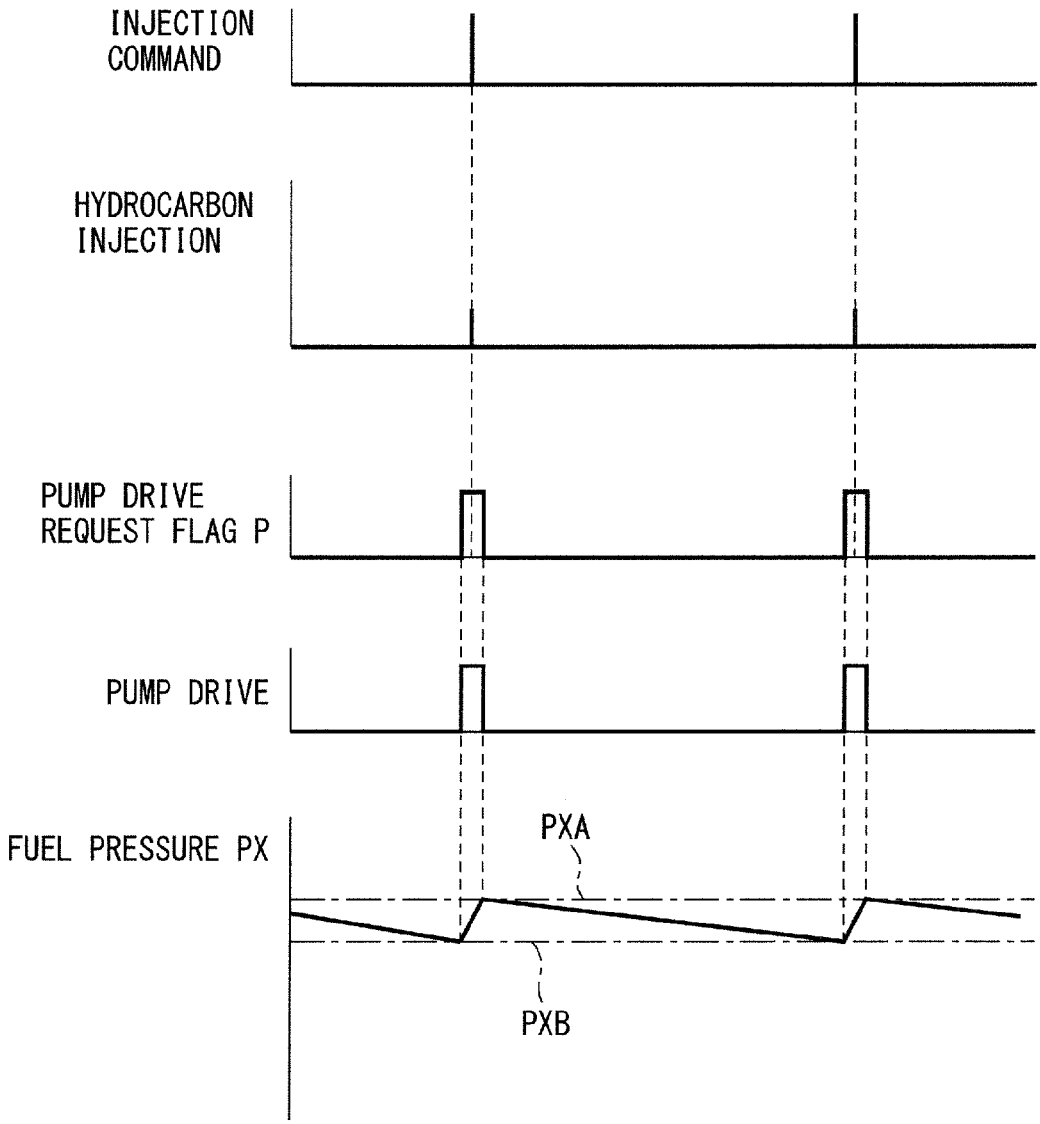
FIG. 16 is a time chart for explaining a relationship among changes in an injection request, a pump driving request, and a fuel pressure PX.

FIG. 16 shows the case when hydrocarbons are injected from the hydrocarbon feed valve 15 for preventing clogging. As shown in FIG. 16, if a command is issued for injection of hydrocarbons from the hydrocarbon feed valve 15 for preventing clogging, hydrocarbons are injected from the hydrocarbon feed valve 15. In this case, when the pump drive request flag P is set and the booster pump 60 is being driven, even if a command is issued for injecting hydrocarbons for preventing clogging, the pump drive request flag P is maintained as set and the booster pump 60 continues to be driven. That is, as explained above, the amount of injection of hydrocarbons which is injected per injection for preventing clogging is an extremely small amount. Therefore, even if the amount of injection of hydrocarbons which is injected per injection for preventing clogging deviates somewhat, there is no adverse effect. On the other hand, at this time, to change the injection timing of hydrocarbons for preventing clogging so that the injection of hydrocarbons for preventing clogging and the boosting action of the fuel pressure PX by the booster pump 60 do not overlap, complicated control becomes required and no merit is gained.

Therefore, in the present invention, the boosting action of the fuel pressure PX by the booster pump 60 and the injection of hydrocarbons for preventing clogging are made to be respectively independently controlled. The injection of hydrocarbons for preventing clogging and the boosting action of the fuel pressure PX by the booster pump 60 are allowed to overlap. That is, in the present invention, the boosting action of the injection pressure PX by the booster device 60 and the clogging prevention injection are allowed to be performed simultaneously.

Figure 17:
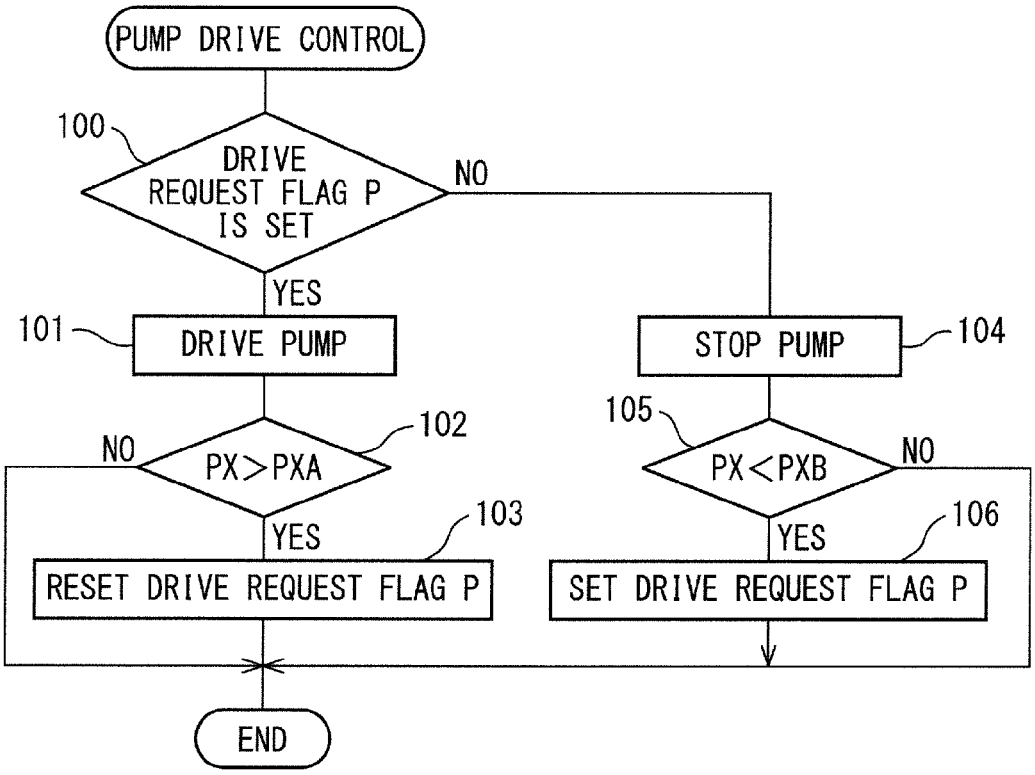
FIG. 17 is a flow chart for drive control of a booster pump.

Next, while referring to FIG. 17 to FIG. 22, the pump drive control and fuel injection control when using a reducing agent constituting hydrocarbons will be explained. FIG. 17 shows a drive control routine of the booster pump. This routine is performed by interruption every predetermined time interval. Referring to FIG. 17, first, at step 100, it is judged if the pump drive request flag P is set. When the pump drive request flag P is set, the routine proceeds to step 101 where the booster pump 60 is driven and the boosting action of the fuel pressure PX of the fuel which is fed to the hydrocarbon feed valve 15 is performed. Next, at step 102, it is judged if the fuel pressure PX exceeds the target fuel pressure PXA. If the fuel pressure PX exceeds the target fuel pressure PXA, the routine proceeds to step 103 where the pump drive request flag P is reset.

If the pump drive request flag P is reset, the routine proceeds from step 100 to step 104 where the booster pump 60 is stopped. Next, at step 105, it is judged if the fuel pressure PX become an allowable lower limit fuel pressure PXB or less. When the fuel pressure PX becomes the allowable lower limit fuel pressure PXB or less, the routine proceeds to step 106 where the pump drive request flag P is set. If the pump drive request flag P is set, the routine proceeds from step 100 to step 101 where the booster pump 60 is driven. In this way, in this embodiment according to the present invention, if the pump drive request flag P is set, the booster pump 60 is driven. The booster pump 60 continues to be driven while the pump drive request flag P is set.

Figure 18:
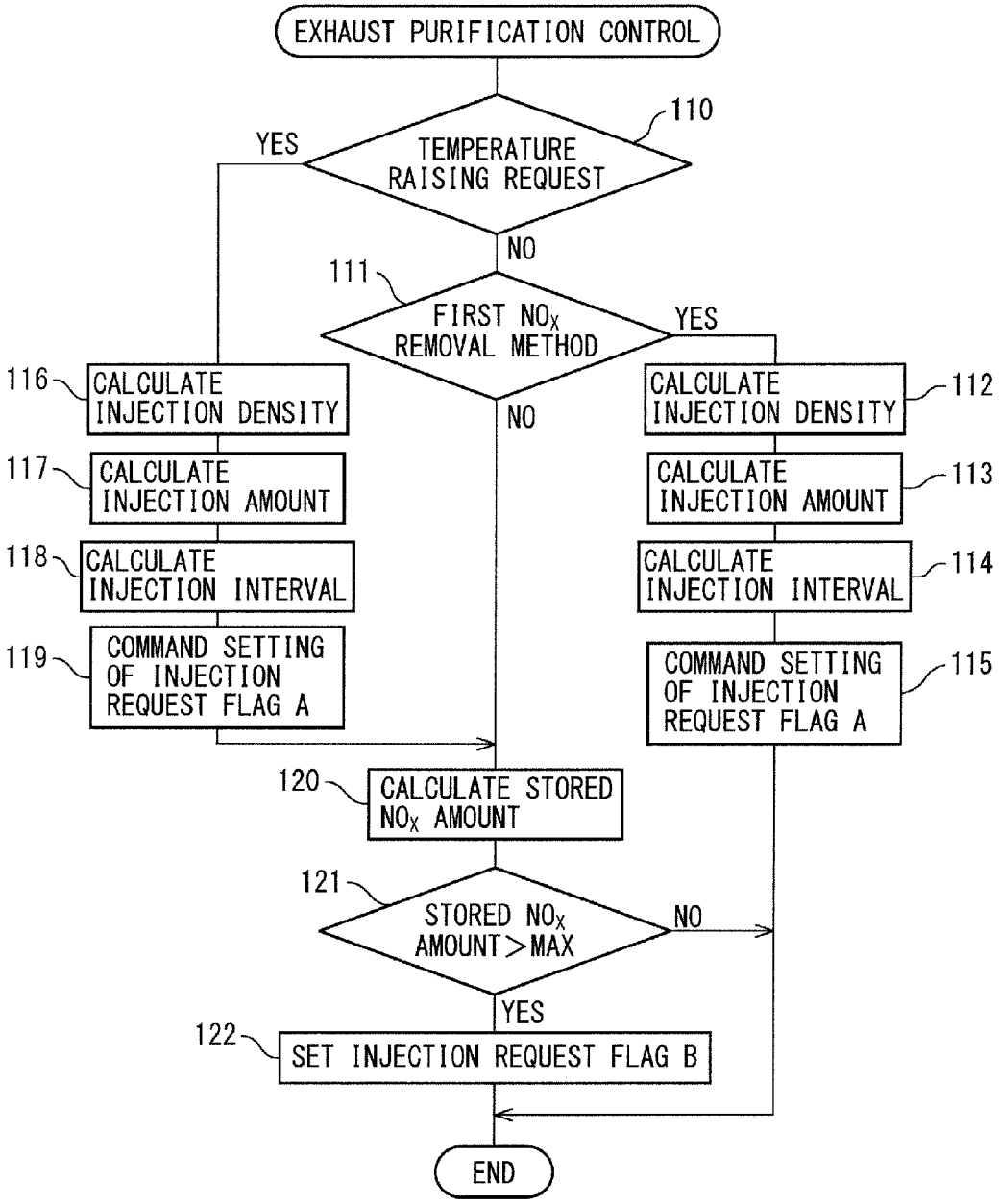
FIG. 18 is a flow chart for exhaust purification control.

FIG. 18 shows a control routine for exhaust purification. This routine is also performed by interruption every predetermined time interval. Referring to FIG. 18, first, at step 110, it is judged if a temperature raising request is issued which shows that the particulate filter 14 or the exhaust purification catalyst 13 should be raised in temperature. When the temperature raising request is not issued, the routine proceeds to step 111 where it is judged if the operating state is one where $NO_X$ should be removed by the first $NO_X$ removal method. When the operating state is one where $NO_X$ should be removed by the first $NO_X$ removal method, the routine proceeds to step 112 where the injection density DX (mg/s) of hydrocarbons is calculated from the map which is shown in FIG. 7A. Next, at step 113, the optimal amount of injection W (mg) of hydrocarbons per injection is calculated from the map which is shown in FIG. 7C.

Next, at step 114, the amount of injection W (mg) of hydrocarbons per injection which was calculated at step 113 is divided by the injection density DX (mg/s) of hydrocarbons which was calculated at step 112 to thereby calculate the injection interval (s) of hydrocarbons. Next, at step 115, the time when hydrocarbons should be injected is found from the injection interval (s) of the hydrocarbons, and a command for setting the injection request flag A is set which shows that the injection request flag A should be set at this found time. Next, the processing cycle is ended.

On the other hand, when it is judged at step 111 that the operating state is not one where $NO_X$ removal by the first $NO_X$ removal method should be performed, the routine proceeds to step 120 where $NO_X$ removal by the second $NO_X$ removal method is performed. That is, at step 120, the amount of $NO_X$ which is stored in the exhaust purification catalyst 13 is calculated. Specifically speaking, if the operating state of the engine is determined, the amount of $NO_X$ which is exhausted from the engine is determined, so the amount of $NO_X$ which is stored in the exhaust purification catalyst 13 is calculated by cumulatively adding the amount of $NO_X$ which is exhausted from the engine. Next, at step 121, it is judged if the amount of $NO_X$ which is stored at the exhaust purification catalyst 13 exceeds a predetermined allowable value MAX. When the amount of $NO_X$ which is stored in the exhaust purification catalyst 13 exceeds the predetermined allowable value MAX, the routine proceeds to step 122 where the injection request flag B is set.

On the other hand, when it is judged at step 110 that the temperature raising request is issued which shows that the particulate filter 14 or the exhaust purification catalyst 13 should be raised in temperature, the routine proceeds to step 116 where temperature raising control is performed. That is, when the temperature raising request is issued which shows that the particulate filter 14 should be raised in temperature, the injection density DY (mg/s) of hydrocarbons per unit time is calculated from the map which is shown in FIG. 7B, next, at step 117, the optimal injection amount W (mg) of hydrocarbons per injection is calculated from the map which is shown in FIG. 7C. Next, at step 118, the injection amount W (mg) of hydrocarbons per injection which was calculated at step 117 is divided by the injection density DY (mg/s) of hydrocarbons which was calculated at step 116 to thereby calculate the injection interval (s) of hydrocarbons. Next, at step 119, the time when hydrocarbons should be injected is found from this injection interval (s) of hydrocarbons. A command is issued for setting an injection request flag A which shows that the injection request flag A should be set at this found time. Next, the routine proceeds to step 120.

As opposed to this, when the temperature raising request is issued which shows that the exhaust purification catalyst 13 should be raised in temperature so as to release the $SO_X$ stored in the exhaust purification catalyst 13 from the exhaust purification catalyst 13, at step 116, the injection density DY (mg/s) of hydrocarbons per unit time is calculated from another map such as shown in FIG. 7B, next, at step 117, the optimal injection amount W (mg) of hydrocarbons per injection is calculated from the map which is shown on FIG. 7C. Next, at step 118, the injection amount W (mg) of hydrocarbons per injection which was calculated at step 117 is divided by the injection density DY (mg/s) of hydrocarbons which was calculated at step 116 to thereby calculate the injection interval (s) of hydrocarbons. Next, at step 119, the time when hydrocarbons should be injected is found from the injection interval (s) of hydrocarbons. At this time, a command of setting the injection request flag which shows that the injection request flag A should be set at this found time is issued. Next, the routine proceeds to step 120.

Figure 19:
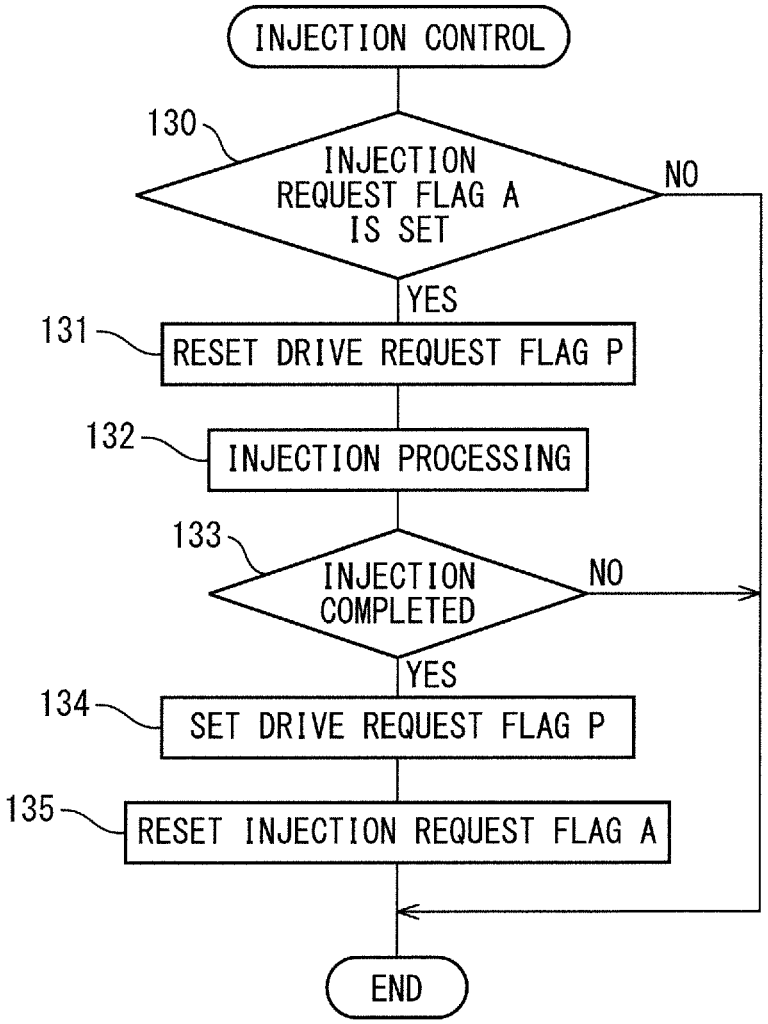
FIG. 19 is a flow chart for injection control.

Next, while referring to FIG. 19, a hydrocarbon injection control routine will be explained. This injection control routine is a routine for working the embodiment which is shown in FIG. 12 and FIG. 13 and shows part of the constantly performed injection control routine. Referring to FIG. 19, first, at step 130, it is judged if the injection request flag A is set. When the injection request flag A is set, the routine proceeds to step 131 where the pump drive request flag P is reset.

Next, at step 132, the injection operation of the hydrocarbons from the hydrocarbon feed valve 15 is performed. Next, at step 133, it is judged if the injection of the hydrocarbons from the hydrocarbon feed valve 15 is completed. When the injection of the hydrocarbons from the hydrocarbon feed valve 15 is completed, the routine proceeds to step 134 where the pump drive request flag P is set, then at step 135, the injection request flag A is reset.

Figure 20:
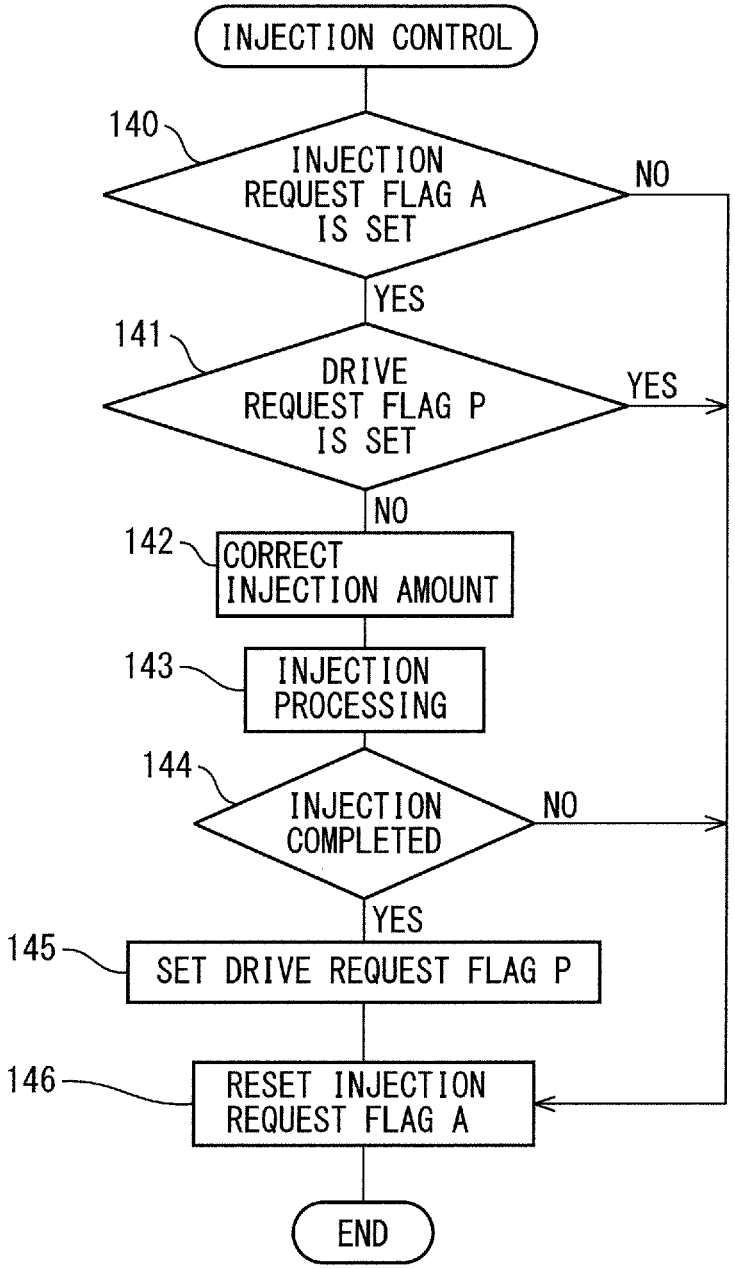
FIG. 20 is a flow chart for injection control.

Next, while referring to FIG. 20, another injection control routine for working the embodiment which is shown in FIG. 14 will be explained. This control injection routine also shows part of the constantly performed injection control routine. If referring to FIG. 20, first, at step 140, it is judged if the injection request flag A is set. When the injection request flag A is set, the routine proceeds to step 141 where it is judged if the pump drive request flag P is set. When the pump drive request flag P is set, the injection routine which is shown in FIG. 20 ends. Therefore, at this time, even if the injection request flag A is set, the injection of the hydrocarbons from the hydrocarbon feed valve 15 is not performed.

As opposed to this, when it is judged at step 141 that the pump drive request flag P is reset, the routine proceeds to step 142 where the injection amount of hydrocarbons is corrected. That is, the hydrocarbon injection densities DX, DY of the hydrocarbons at the time of injection of hydrocarbons are increased by exactly to the ratio of increase of the injection intervals, and the injection amount per action is recalculated from the increased injection densities DX, DY. Next, at step 143, the injection operation of the hydrocarbons from the hydrocarbon feed valve 15 is performed. Next, at step 144, it is judged if the injection of the hydrocarbons from the hydrocarbon feed valve 15 is completed. When the injection of the hydrocarbons from the hydrocarbon feed valve 15 is completed, the routine proceeds to step 145 where the pump drive request flag P is set, then at step 146, the injection request flag A is reset.

Figure 21:
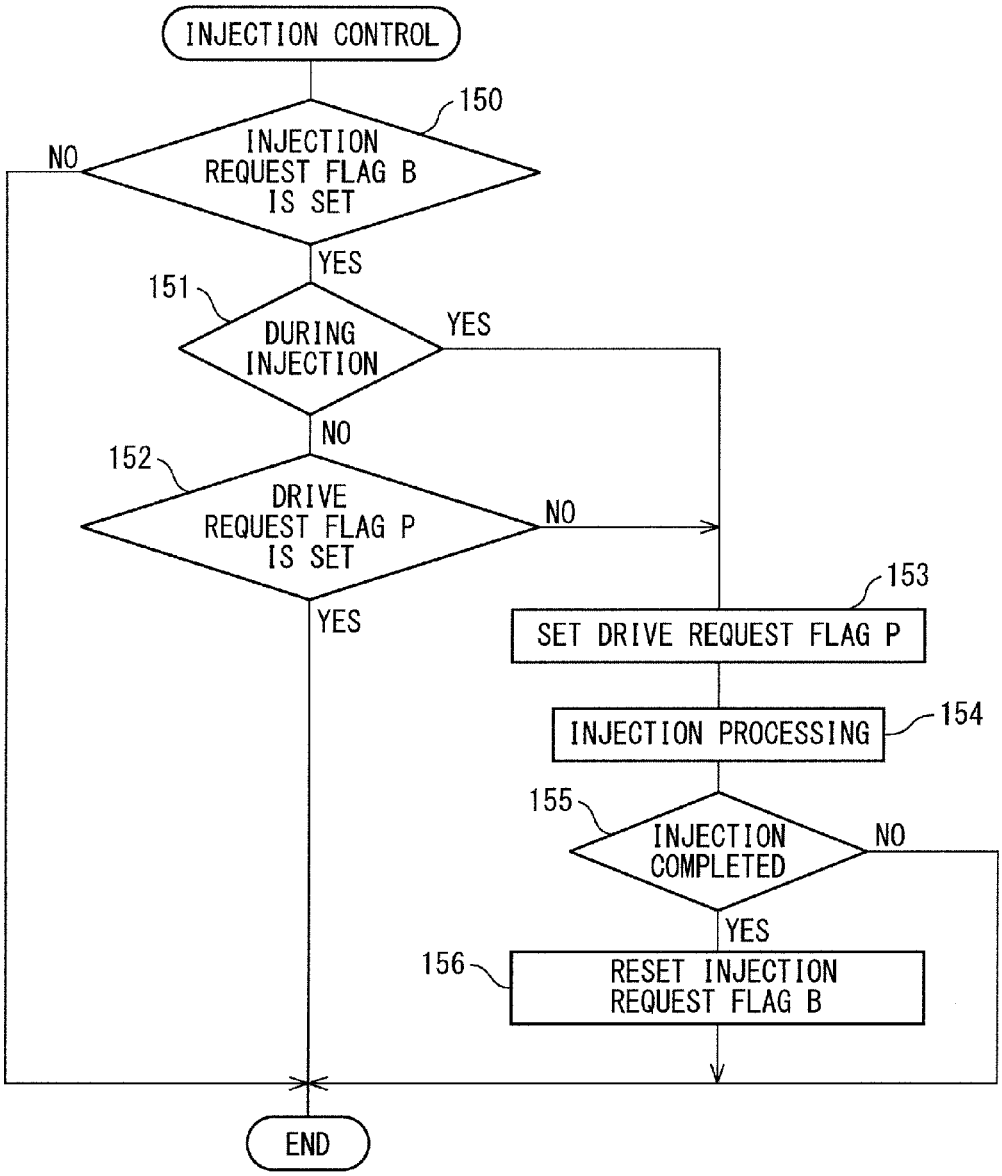
FIG. 21 is a flow chart for injection control.

Next, while referring to FIG. 21, an injection control routine for working the embodiment which is shown in FIG. 15 will be explained. This control injection routine also shows part of the constantly performed injection control routine. Referring to FIG. 21, first, at step 150, it is judged if the injection request flag B is set. When the injection request flag B is set, the routine proceeds to step 151 where it is judged if the hydrocarbon feed valve 15 is in the middle of injecting hydrocarbons. If not in the middle of injecting hydrocarbons, the routine proceeds to step 152 where it is judged if the pump drive request flag P is set. When the pump drive request flag P is set, the injection control routine which is shown in FIG. 21 is ended. At this time, the booster pump 60 continues to be driven.

On the other hand, when it is judged at step 152 that the pump drive request flag P is reset, the routine proceeds to step 153 where the pump drive request flag P is set. Next, at step 154, the injection operation of the hydrocarbons from the hydrocarbon feed valve 15 is performed. If the hydrocarbon feed valve 15 starts injecting hydrocarbons, at the next processing cycle, the routine proceeds from step 151 to step 153. Next, at step 155, it is judged if the injection of the hydrocarbons from the hydrocarbon feed valve 15 is completed. When the injection of the hydrocarbons from the hydrocarbon feed valve 15 is completed, the routine proceeds to step 156 where the injection request flag B is reset. At this time as well, the booster pump 60 continues to be driven.

Figure 22:
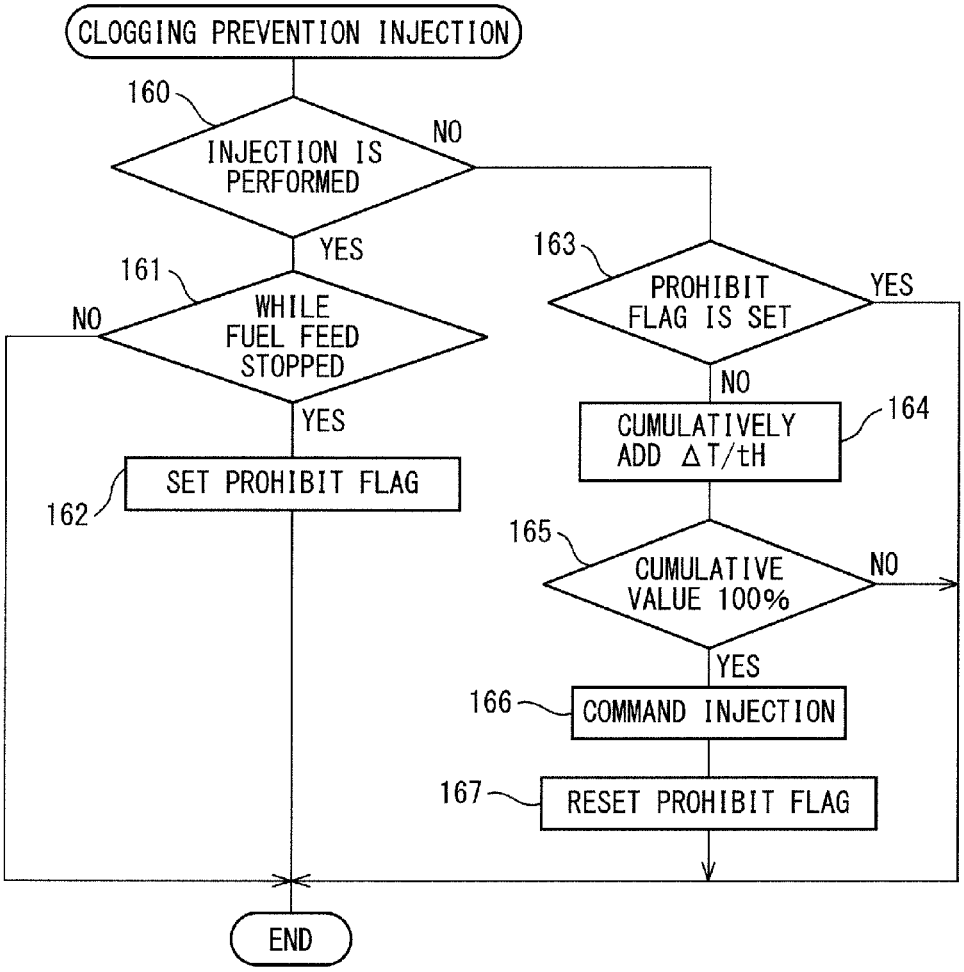
FIG. 22 is a flow chart for clogging prevention injection control.

FIG. 22 shows a control routine of clogging prevention injection. This control routine is performed by interruption every predetermined time interval. Referring to FIG. 22, first, at step 160, it is judged if the clogging prevention injection from the hydrocarbon feed valve 15 has been performed based on an injection command for preventing clogging in the time from the previous interruption to the current interruption. When the clogging prevention injection has been performed, the routine proceeds to step 161 where it is judged if the feed of fuel to the combustion chamber 2 was stopped when the clogging prevention injection was performed. If, when the clogging prevention injection was performed, the feed of fuel into the combustion chamber 2 was stopped, the routine proceeds to step 162 where a prohibit flag for prohibiting clogging prevention injection is set.

On the other hand, when it is judged at step 160 that the clogging prevention injection from the hydrocarbon feed valve 15 has not been performed, the routine proceeds to step 163 where it is judged if the prohibit flag is set. When the prohibit flag is not set, that is, if, when the feed of fuel into the combustion chamber 2 was performed, the clogging prevention injection was performed, the routine proceeds to step 164, where, from the relationship which is shown in FIG. 9, the elapsed time tH until the degree of deposition of soot reaches the allowable degree of deposition GX at the temperature TB of the front end face 80 of the hydrocarbon feed valve 15 is found, and the cumulative value of the value of $\Delta T/tH$ is calculated by cumulatively adding the value of the ratio $\Delta T/tH$ of the routine interruption time $\Delta T$ with respect to this elapsed time tH.

Next, at step 165, it is judged if the cumulative value of the value of ΔT/tH reaches 100%. When the cumulative value of the value of ΔT/tH reaches 100%, the routine proceeds to step 166 where a command is issued for the hydrocarbon feed valve 15 to inject clogging prevention hydrocarbons. Next, at step 167, the prohibit flag is reset, and the value of cumulative value of the value of ΔT/tH is cleared.

REFERENCE SIGNS LIST

4. intake manifold
5. exhaust manifold
12. exhaust pipe
13. exhaust purification catalyst
14. particulate filter
15. hydrocarbon feed valve
60. booster device

The invention claimed is:

1. A control system of an internal combustion engine comprising:

a reducing agent feed valve arranged in an engine exhaust passage;

an $NO_X$ purification catalyst that removes $NO_X$ by a reducing agent injected from the reducing agent feed valve;

a booster pump that boosts an injection pressure of a reducing agent injected from the reducing agent feed valve; and an electronic control unit operatively connected to the reducing agent feed valve and the booster pump, wherein the electronic control unit is configured to control the reducing agent feed valve to perform:

a $NO_X$ removal injection of injection of the reducing agent from the reducing agent feed valve which is repeatedly performed within a predetermined range of period so as to remove $NO_X$; and a clogging prevention injection of injection of the reducing agent from the reducing agent feed valve which is made smaller in amount of injection compared with the $NO_X$ removal injection for preventing clogging of nozzle holes of the reducing agent feed valve, wherein the electronic control unit is configured to control the booster pump to perform a boosting action of the injection pressure by the booster pump, wherein the electronic control unit is configured to control the reducing agent feed valve and the booster pump such that the boosting action of the injection pressure by the booster pump and the $NO_X$ removal injection are not simultaneously performed, and the boosting action of the injection pressure by the booster pump and the clogging prevention injection are allowed to be performed simultaneously.

2. The control system of an internal combustion engine of claim 1, wherein when a request for the boosting action of injection pressure by the booster pump and a request for the $NO_X$ removal injection overlap, the boosting action of the injection pressure by the booster pump is put off and the $NO_X$ removal injection is performed with priority and the boosting action of the injection pressure by the booster pump is started or resumed after the $NO_X$ removal injection is completed.

3. The control system of an internal combustion engine of claim 1, wherein when a request for the boosting action of injection pressure by the booster pump and a request for the $NO_X$ removal injection overlap, the $NO_X$ removal injection is put off and the boosting action of the injection pressure by the booster pump is performed with priority and the $NO_X$ removal injection is started after the boosting action of the injection pressure by the booster pump is completed.

4. The control system of an internal combustion engine of claim 3, wherein when an injection interval of the $NO_X$ removal injection is made to increase by performing the boosting action of the injection pressure by the booster pump with priority, the amount of injection of the $NO_X$ removal injection is increased by exactly a ratio of increase of the injection interval.

5. The control system of an internal combustion engine of claim 1, wherein the electronic control unit controls the reducing agent feed valve to perform a temperature raising injection of injection of the reducing agent from the reducing agent feed valve which is repeatedly performed for raising a temperature of at least one of a particulate filter and the NOx purification catalyst arranged in the engine exhaust passage, and the boosting action of the injection pressure by the booster pump and the temperature raising injection are controlled so that the boosting action of the injection pressure by the booster pump and the temperature raising injection are not simultaneously performed.

6. The control system of an internal combustion engine of claim 5, wherein when a request for the boosting action of the injection pressure by the booster pump and a request for the temperature raising injection overlap, the boosting action of the injection pressure by the booster pump is put off and the temperature raising injection is performed with priority and the boosting action of the injection pressure by the booster pump is started or resumed after the temperature raising injection is completed.

7. The control system of an internal combustion engine of claim 5, wherein when a request for the boosting action of the injection pressure by the booster pump and a request for the temperature raising injection overlap, the temperature raising injection is put off and the boosting action of the injection pressure by the booster pump is performed with priority and the temperature raising injection is started the said boosting action of the injection pressure by the booster pump is completed.

8. The control system of an internal combustion engine of claim 1, wherein the NOx purification catalyst includes a storage catalyst configured to store NOx, the electronic control unit controls the reducing agent feed valve to perform an NOx release-use injection of injection of the reducing agent from the reducing agent feed valve which is performed for releasing NOx stored in the NOx storage catalyst from the NOx storage catalyst, and, when the NOx release-use injection is performed, the boosting action of the injection pressure by the booster pump is simultaneously performed.

9. The control system of an internal combustion engine of claim 8, wherein when the boosting action of the injection pressure by the booster pump is being performed when there is a request for the $NO_X$ release-use injection, the $NO_X$ release-use injection is put off until the injection pressure reaches a predetermined target injection pressure and the $NO_X$ release-use injection is started after the injection pressure reaches the predetermined target injection pressure.

* * * * *